US009199127B2

(12) United States Patent
Hogge et al.

(10) Patent No.: US 9,199,127 B2
(45) **Date of Patent: *Dec. 1, 2015**

(54) COLOR GOLF BALL

(75) Inventors: Matthew F. Hogge, Plymouth, MA (US); Jason Williams, Fairhaven, MA (US)

(73) Assignee: Acushnet Company, Fairhaven, MA (US)

( * ) Notice: Subject to any disclaimer, the term of this patent is extended or adjusted under 35 U.S.C. 154(b) by 694 days.

This patent is subject to a terminal disclaimer.

(21) Appl. No.: 13/429,485

(22) Filed: Mar. 26, 2012

(65) Prior Publication Data

US 2013/0252760 A1 Sep. 26, 2013

(51) Int. Cl.

| | |
|---|---|
| ***A63B 37/06*** | (2006.01) |
| ***A63B 37/00*** | (2006.01) |
| ***A63B 43/00*** | (2006.01) |
| ***A63B 43/06*** | (2006.01) |

(52) U.S. Cl.

CPC ..... *A63B 37/0003* (2013.01); *A63B 37/0022* (2013.01); *A63B 37/0074* (2013.01); *A63B 37/0075* (2013.01); *A63B 37/0076* (2013.01); *A63B 43/008* (2013.01); *A63B 43/06* (2013.01); *A63B 37/0024* (2013.01); *A63B 37/0027* (2013.01); *A63B 37/0039* (2013.01); *A63B 37/0051* (2013.01); *A63B 37/0058* (2013.01)

(58) Field of Classification Search

CPC ..... A63B 37/12
USPC ..... 473/378, 377
See application file for complete search history.

(56) References Cited

U.S. PATENT DOCUMENTS

| | | | |
|---|---|---|---|
| 2,283,845 | A | 1/1940 | Brown |
| 2,809,954 | A | 10/1957 | Kazenas |
| 2,851,424 | A | 9/1958 | Switzer et al. |
| 2,938,873 | A | 5/1960 | Kazenas |
| 3,253,146 | A | 5/1966 | de Vries |
| 3,412,036 | A | 11/1968 | McIntosh |
| D228,394 | S | 9/1973 | Martin et al. |
| 3,989,568 | A | 11/1976 | Isaac |
| 4,123,061 | A | 10/1978 | Dusbiber |
| 4,128,600 | A | 12/1978 | Skinner et al. |
| 4,317,933 | A | 3/1982 | Parker |
| 4,342,793 | A | 8/1982 | Skinner et al. |
| 4,560,168 | A | 12/1985 | Aoyama |
| 4,679,795 | A | 7/1987 | Melvin et al. |
| 4,798,386 | A | 1/1989 | Berard |
| 4,804,189 | A | 2/1989 | Gobush |
| 4,921,759 | A | 5/1990 | Orain et al. |
| 4,925,193 | A | 5/1990 | Melvin |
| 4,950,696 | A | 8/1990 | Palazotto et al. |
| 4,960,281 | A | 10/1990 | Aoyama |
| 4,985,340 | A | 1/1991 | Palazzotto et al. |
| 4,991,852 | A | 2/1991 | Pattison |
| 4,998,734 | A | 3/1991 | Meyer |
| 5,000,458 | A | 3/1991 | Proudfit |
| 5,018,742 | A | 5/1991 | Isaac et al. |
| 5,143,377 | A | 9/1992 | Oka et al. |
| 5,147,900 | A | 9/1992 | Palazzotto et al. |
| 5,156,405 | A | 10/1992 | Kitaoh et al. |
| 5,249,804 | A | 10/1993 | Sanchez |
| 5,256,170 | A | 10/1993 | Harmer et al. |
| 5,326,621 | A | 7/1994 | Palazzotto et al. |
| 5,334,673 | A | 8/1994 | Wu |
| 5,360,462 | A | 11/1994 | Harmer et al. |
| 5,376,428 | A | 12/1994 | Palazzotto et al. |
| 5,427,378 | A | 6/1995 | Murphy |
| 5,442,680 | A | 8/1995 | Schellinger et al. |
| 5,484,870 | A | 1/1996 | Wu |
| 5,494,291 | A | 2/1996 | Kennedy |
| 5,562,552 | A | 10/1996 | Thurman |
| 5,575,477 | A | 11/1996 | Hwang |
| 5,605,761 | A | 2/1997 | Burns et al. |
| 5,672,643 | A | 9/1997 | Burns et al. |
| 5,674,622 | A | 10/1997 | Burns et al. |
| 5,688,191 | A | 11/1997 | Cavallaro et al. |
| 5,692,974 | A | 12/1997 | Wu et al. |
| 5,713,801 | A | 2/1998 | Aoyama |
| 5,783,293 | A | 7/1998 | Lammi |
| 5,800,286 | A | 9/1998 | Kakiuchi et al. |

(Continued)

FOREIGN PATENT DOCUMENTS

| | | |
|---|---|---|
| JP | 2001-087423 | 4/2001 |

OTHER PUBLICATIONS

Mark S. Murphy; "Just Different Enough" Golf World Business; Apr. 8, 2005; p. 2.
Wilson Hope golf ball, http://www.pargolf.com/products/Wilson-Hope.htm, Jan. 27, 2005.
Color photographs of Volvik "Crystal" golf ball and packaging, 2005.
Volvik Crystal golf ball, http://www.volvik.co.kr/english/product/crystal.asp, Jan. 21, 2005.
Volvik Golf Ball Brochure, 2005, pp. 1, 16-17 and 24.
Color photographs of Volvik "Crystal" golf ball, 2004.

(Continued)

*Primary Examiner* — Raeann Gorden
(74) *Attorney, Agent, or Firm* — Margaret C. Barker

(57) ABSTRACT

The present invention is directed to a golf ball comprising a core, a cover and optionally an intermediate layer disposed between the core and the cover which in any combination comprise at least two color contributing components, each of which comprises a colorant that contributes to an overall golf ball color, the color contributing components having substantially similar hues and different saturations, wherein the hue and saturation and a chroma of each contributing component contributes to an overall golf ball hue, saturation and chroma such that: the overall golf ball hue is substantially similar to the hue of each color contributing component; the overall golf ball saturation is different than the saturation of at least one of the color contributing components; and the overall golf ball chroma is different than the chroma of at least one of the color contributing components.

21 Claims, No Drawings

(56) References Cited

U.S. PATENT DOCUMENTS

| | | | |
|---|---|---|---|
| 5,803,831 | A | 9/1998 | Sullivan et al. |
| 5,820,488 | A | 10/1998 | Sullivan et al. |
| 5,823,890 | A | 10/1998 | Maruko et al. |
| 5,823,891 | A | 10/1998 | Winskowicz |
| 5,840,788 | A | 11/1998 | Lutz et al. |
| 5,885,172 | A | 3/1999 | Hebert et al. |
| 5,900,439 | A | 5/1999 | Prissok et al. |
| 5,902,191 | A | 5/1999 | Masutani et al. |
| 5,919,100 | A | 7/1999 | Boehm et al. |
| 5,929,189 | A | 7/1999 | Ichikawa et al. |
| 5,938,544 | A | 8/1999 | Winskowicz |
| 5,957,786 | A | 9/1999 | Aoyama |
| 5,957,787 | A | 9/1999 | Hwang |
| 5,965,669 | A | 10/1999 | Cavallaro et al. |
| 5,981,654 | A | 11/1999 | Rajagopalan |
| 5,981,658 | A | 11/1999 | Rajagopalan |
| 5,989,135 | A | 11/1999 | Welch |
| 5,993,968 | A | 11/1999 | Umezawa et al. |
| 6,056,842 | A | 5/2000 | Dalton et al. |
| 6,083,119 | A | 7/2000 | Sullivan et al. |
| 6,120,394 | A | 9/2000 | Kametani |
| 6,149,535 | A | 11/2000 | Bissonnette et al. |
| 6,152,834 | A | 11/2000 | Sullivan |
| 6,200,232 | B1 | 3/2001 | Kasashima et al. |
| 6,207,784 | B1 | 3/2001 | Rajagopalan |
| 6,251,991 | B1 | 6/2001 | Takesue et al. |
| 6,277,037 | B1 | 8/2001 | Winskowicz et al. |
| 6,358,160 | B1 | 3/2002 | Winskowicz |
| 6,369,125 | B1 | 4/2002 | Nesbitt |
| 6,450,902 | B1 | 9/2002 | Hwang |
| 6,548,618 | B2 | 4/2003 | Sullivan et al. |
| 6,558,227 | B1 | 5/2003 | Kodaira et al. |
| 6,790,149 | B2 | 9/2004 | Kennedy et al. |
| 6,824,476 | B2 | 11/2004 | Sullivan et al. |
| 6,872,154 | B2 | 3/2005 | Shannon et al. |
| 6,949,595 | B2 | 9/2005 | Morgan et al. |
| 7,090,798 | B2 | 8/2006 | Hebert et al. |
| 7,220,192 | B2 | 5/2007 | Andre et al. |
| 7,291,076 | B2 | 11/2007 | Watanabe |
| 8,915,803 | B2 * | 12/2014 | Hogge et al. ..... 473/378 |
| 2002/0086743 | A1 | 7/2002 | Bulpett |
| 2004/0176184 | A1 | 9/2004 | Morgan et al. |
| 2004/0176185 | A1 | 9/2004 | Morgan et al. |
| 2004/0176188 | A1 | 9/2004 | Morgan et al. |
| 2005/0148409 | A1 | 7/2005 | Morgan et al. |
| 2007/0149323 | A1 | 6/2007 | Morgan et al. |
| 2009/0137343 | A1 * | 5/2009 | Morgan et al. ..... 473/374 |
| 2011/0086728 | A1 | 4/2011 | Hogge et al. |
| 2012/0015763 | A1 | 1/2012 | Isogawa et al. |
| 2012/0021851 | A1 | 1/2012 | Hogge |

OTHER PUBLICATIONS

Color photographs of Wilson "iWound", display model only with clear cover, 2001.

"Urea", Kirk-Othmer Encyclopedia of Chemical Technology. John Wiley & Sons, Inc. copyright 1998.

Color Photographs of Wilson "Quantum" golf ball, late 1990s.

Color Photographs of Pro Keds "Crystal π" golf ball, 1980's.

* cited by examiner

COLOR GOLF BALL

FIELD OF THE INVENTION

The invention relates generally to golf balls incorporating color, pigments dyes, tints and color effects to optimize golf ball appearance and golfer performance.

BACKGROUND OF THE INVENTION

Golf balls, whether of solid or wound construction, generally include a core and at least a cover or outer coating. Solid golf balls, as compared with wound balls, provide better distance than wound balls due to their lower driver initial spin. Meanwhile, the wound construction provides a softer "feel" and higher spin rate—characteristics often preferred by accomplished golfers who are able to control the ball's flight and positioning.

The properties of a conventional solid ball may be modified by altering the typical single layer core and single cover layer construction to provide a ball having at least one intermediate layer disposed between the cover and the core. The core may be solid or fluid-filled, and may be formed of a single layer or one or more layers. Covers, in addition to cores, may also be formed of one or more layers. These multi-layer cores and covers are sometimes known as "dual core" and "dual cover" golf balls, respectively. One piece golf balls are also available. The difference in play characteristics resulting from these different types of constructions can be quite significant. The playing characteristics of multi-layer balls, such as spin and compression, can be tailored by varying the properties of one or more of the core, intermediate and/or cover layers. By altering golf ball construction and composition, manufacturers can vary a wide range of playing characteristics such as resilience, durability, spin, and "feel", optimizing each according to various playing abilities and achieving a solid golf ball possessing feel characteristics more like their wound predecessors.

Meanwhile, color in a golf ball, being a dominant visual feature, is also capable of positively contributing to and enhancing a golfer's game by improving the player's ability to focus on the golf ball when swinging a club and striking the ball. For example, it is desirable that a golfer's eye be drawn to the ball easily. By keeping an eye on the ball, the golfer is able to remain focused on the immediate task at hand of maintaining hand-eye coordination and producing great balance during swing with consistent spine angle in order for the club face to strike the golf ball with just the right force, depending on the chosen club and desired distance. In this way, a golf ball's unique visual appearance can influence and improve the golfer's physical performance substantially.

Furthermore, golf balls that are attractive and exude superior quality will also positively contribute to the psychological aspects of a golfer's game by boosting the golfer's confidence and morale, thereby motivating, inspiring and ultimately peaking performance on the green. Additionally, visually superior golf balls may be spotted and located more easily on the golf course, thereby reducing a player's stress level which naturally translates into improved scores. Accordingly, golf ball manufacturers desire to incorporate color in golf balls in order to beneficially impact and improve both the physical and emotional/psychological aspects of a golfer's game.

Toward this end, golf ball manufacturers have heretofore applied several well-known and widely accepted color spaces for defining, measuring and incorporating color in golf balls. Certain terms, such as hue, saturation and chroma traverse each of these color spaces. In fact, some basic qualities and aspects of hue, saturation and chroma hold true irrespective of the particular color space adopted to define color. Accordingly, there remains a need for golf balls possessing superior overall color appearance as perceived by the human eye, achieved by coordinating these basic common qualities. The present invention addresses and solves this problem.

SUMMARY OF THE INVENTION

Golf balls of the invention incorporate and coordinate "hue", "saturation" and "chroma" in golf ball color contributing components without being limited to a particular color space for defining color. An optimally appealing golf ball results from coordinating the independent contribution of each of these qualities to an overall golf ball color.

Universally, "hue" of a given color means which color, whether spectral or nonspectral, a particular shade, pigment, dye, tint, etc. resembles most closely. See, e.g., *The Dimensions of Colour*, by David Briggs, www.huevaluechroma-.com. That is, whether the color may be categorized as being red, yellow, blue, green, orange, purple, pink, etc.

Meanwhile, the term "saturation" describes how pure a color is—that is, the dominance of hue in the color. Id. A color's saturation is not dependent on how dim or bright the independent surface lighting is. Id. Instead, a color's saturation may be reduced by reducing the dominance of the hue in the color. Id. Thus, a golf ball's overall golf ball color is directly influenced by predetermining the saturation of at least one color contributing component, notwithstanding the particular hue and/or the chroma.

In turn, the term "chroma" represents the strength of a surface color. Id. Unlike saturation, a color's chroma is dependent on lightness. Id. For a given saturation, chroma will be greatest at intermediate lightness levels and will be zero at both maximum and minimum lightness levels (which ranges from black to white). Id. And chroma will be greater for the hue "red" than for the hue "brown' at a constant lightness value. Id. In fact, two surfaces may have the same saturation or intensity yet higher chroma if one surface gives off more light under the same conditions as the other. Id. A colored surface that reflects light of high saturation and high brightness will have high chroma. Id.

A golf ball of the invention has a unique and aesthetically pleasing overall golf ball color appearance resulting from and influenced by relative contributions of saturation and chroma in at least two color contributing components to an overall golf ball saturation and chroma. Meanwhile, the hues of each color contributing component are substantially similar. The inventive golf ball exudes a multi-dimensional color appearance (as opposed to flat) and exhibits a sense of depth (richness or intensity) or fullness to the viewer notwithstanding the lighting conditions or the backdrop against which a ball is positioned based on the independent contribution of saturation and chroma to an overall golf ball saturation and chroma. Through this dual and simultaneous focus within each color contributing component on saturation, which is independent of lighting conditions, and chroma, which is dependent on lighting conditions, an overall golf ball is achieved that is highly appealing irrespective of lighting conditions or the backdrop against which a ball is positioned.

In one embodiment, a golf ball of the invention comprises a core and a cover disposed about the core wherein the core comprises at least one layer comprising a first color contributing component and wherein the cover comprises at least one layer comprising a second color contributing component. The first color contributing component comprises a colorant that contributes to an overall golf ball color, and the second color contributing component comprising a colorant that contributes to the overall golf ball color. The first color contributing component has a hue that is substantially similar to a hue of the second color contributing component and a saturation that is different than a saturation of the second color contributing component. The hue, saturation and a chroma of the first color contributing component and the hue, saturation and a chroma of the second color contributing component each contribute to an overall golf ball hue, saturation and chroma such that: the overall golf ball hue is substantially similar to the hue of the first color contributing component and the hue of the second color contributing component; the overall golf ball saturation is different than the saturation of at least one of the first color contributing component and the second color contributing component; and the overall golf ball chroma is different than at least one of the chroma of the first color contributing component and the chroma of the second color contributing component.

Herein, the term "color contributing component" refers to a core, golf ball layer or coating having one predominant color that contributes to an overall golf ball color. The predominant color within the color contributing component may be produced by one or multiple color-containing materials/ingredients that are mixed together or otherwise combined to produce the predominant color. The predominant color is the main or visually prevalent color in the color contributing component. Color-containing materials are considered different where at least one of their respective hues, saturations and chromas are different. Overall golf ball color, as used herein, refers to the resulting overall golf ball color provided by each predominant color of each color contributing component.

A different saturation in each color contributing component may be achieved by directly adjusting the amount of hue in each predominant color or even by modifying the thickness and/or degree of transparency of a color contributing component containing the predominant color. Accordingly, in one embodiment, the thickness of the first color contributing component is different than the thickness of second color contributing component by less than about 1%. In another embodiment, the thickness of the first color contributing component is different than the thickness of second color contributing component by at least about 1%. In yet another embodiment, the thickness of the first color contributing component is different than the thickness of second color contributing component by about 5%. In still another embodiment, the thickness of the first color contributing component is different than the thickness of second color contributing component by about 10%. In a different embodiment, the thickness of the first color contributing component is different than the thickness of second color contributing component by at least about 20%.

In one embodiment, the translucency of the first color contributing component is different than the translucency of second color contributing component by less than about 5%. In another embodiment, the t translucency of the first color contributing component is different than the translucency of second color contributing component by about 5% or greater. In yet another embodiment, the translucency of the first color contributing component is different than the translucency of second color contributing component by from about 10% to about 20%. In still another embodiment, the translucency of the first color contributing component is different than the translucency of second color contributing component by from about 15% to about 25%. In a different embodiment, the translucency of the first color contributing component is different than the translucency of second color contributing component by from about 20% to about 35%. The translucency of the first color contributing component may alternatively differ from the translucency of the second color contributing component by greater than about 35%, or greater than about 50%, or greater than about 65%, or greater than about 75%, or greater than 80%, or greater than about 90%.

Where the predominant color of a color contributing component is achieved through an interference effect pigment, the predominant color is the color that has travelled sufficiently in the pigment medium such that it is most perceived by the human eye when viewing the golf ball outer surface, thereby excluding the other less prominent colors existing or captured within the interference effect pigment.

In one embodiment, the overall golf ball saturation is greater than the saturation of the first color contributing component and less than the saturation of the second color contributing component. In another embodiment, the overall golf ball saturation is less than the saturation of the first color contributing component and greater than the saturation of the second color contributing component. In yet another embodiment, the overall golf ball saturation is greater than the saturation of the first color contributing component and greater than the saturation of the second color contributing component.

In one embodiment, the saturation of the first color contributing component and the saturation of the second color contributing component differ by from about 95% to about 99%. In another embodiment, the saturation of the first contributing component and the saturation of the second color contributing component differ by from about 90% to about 99%. In yet another embodiment, the saturation of the first color contributing component and the saturation of the second color contributing component differ by from about 80% to about 90%. In still another embodiment, the saturation of the first color contributing component and the saturation of the second color contributing component differ by from about 70% to about 80%. Alternatively, the saturation of the first color contributing component and the saturation of the second color contributing component may differ by from about 50% to about 70%. Also, the saturation of the first color contributing component and the saturation of the second color contributing component may differ by from about 15% to about 50%.

In a different embodiment, the saturation of the color first contributing component and the saturation of the second color contributing component differ by at least about 10%, or by at least about 15%, or by at least about 25%, or by at least about 40%, or by at least about 50%, or by at least about 65%, or by at least about 75%, or by at least about 85%, or by at least about 87%, or by at least about 90%, or by at least about 94%, or by at least about 95%, or by at least about 98%, or by at least about 99%.

The saturation of the first color contributing component and the saturation of the second color contributing component may also differ by greater than about 12%, or by greater than about 15%, or by greater than about 19%, or by greater than about 27%, or by greater than about 33%, or by greater than about 45%, or by greater than about 56%, or by greater than about 65%, or by greater than about 72%, or by greater than about 75%, or by greater than about 80%, or by greater than about 83%, or by greater than about 85%, or by greater than about 88%, or by greater than about 90% or by greater than about 93% or by greater than about 95%, or by greater than about 98%, or by greater than about 99%.

In one embodiment, the saturation of the first color contributing component and the saturation of the second color contributing component differ by up to about 99%, or by up to about 95%, or by up to about 92%, or by up to about 90%, or by up to about 85%, or by up to about 82%, or by up to about 80%, or by up to about 78%, or by up to about 75%, or by up to about 70%, or by up to about 66%, or by up to about 61%, or by up to about 55%, or by up to about 50%, or by up to about 40%, or by up to about 35%, or by up to about 30%, or by up to about 28%, or by up to about 25%, or by up to about 22%, or by up to about 18%, or by up to about 15%, or by up to about 13%, or by up to about 8%.

In another embodiment, the saturation of the first color contributing component and the saturation of the second color contributing component differ by less than about 100%, or by less than about 99%, or by less than about 98%, or by less than about 95%, or by less than about 90%, or by less than about 85%, or by less than about 80%, or by less than about 75%, or by less than about 70%, or by less than about 60%, or by less than about 50%, or by less than about 40%, or by less than about 30%, or by less than about 25%, or by less than about 20%, or by less than about 15%, or by less than about 10%.

The overall golf ball saturation may be different than at least one of the saturation of the first color contributing component and the saturation of the second color contributing component by less than about 100%, or by less than about 99%, or by less than about 95%, or by less than about 90%, or by less than about 85%, or by less than about 80%, or by less than about 75%, or by less than about 70%, or by less than about 65%, or by less than about 60%, or by less than about 55%, or by less than about 50%, or by less than about 45%, or by less than about 40%, or by less than about 35%, or by less than about 30%, or by less than about 25%, or by less than about 20%, or by less than about 15%, or by less than about 10%.

The overall golf ball saturation may alternatively be different than at least one of the saturation of the first color contributing component and the saturation of the second color contributing component by up to about 99%, or by up to about 97%, or by up to about 95%, or by up to about 93%, or by up to about 90%, or by up to about 88%, or by up to about 85%, or by up to about 83%, or by up to about 78%, or by up to about 75%, or by up to about 73%, or by up to about 70%, or by up to about 67%, or by up to about 65%, or by up to about 60%, or by up to about 58%, or by up to about 55%, or by up to about 50%, or by up to about 45%, or by up to about 40%, or by up to about 35%, or by up to about 30%, or by up to about 25%, or by up to about 20%, or by up to about 15%, or by up to about 10%.

In another embodiment, the overall golf ball saturation is different than at least one of the saturation of the first color contributing component and the saturation of the second color contributing component by at least about 5%, or by at least about 10%, or by at least about 15%, or by at least about 25%, or by at least about 38%, or by at least about 45%, or by at least about 50%, or by at least about 65%, or by at least about 75%, or by at least about 80%, or by at least about 90%, or by at least about 95%, or by at least about 97%, or by at least about 98%, or by at least about 99.

The overall golf ball saturation may also be different than at least one of the saturation of the first color contributing component and the saturation of the second color contributing component by at greater than about 99%, or by greater than about 97%, or by greater than about 95%, or by greater than about 90%, or by greater than about 85%, or by greater than about 80%, or by greater than about 75%, or by greater than about 60%, or by greater than about 50%, or by greater than about 44%, or by greater than about 35%, or by greater than about 25%, or by greater than about 17%, or by greater than about 12%, or by greater than about 5%.

In yet another embodiment, the overall golf ball saturation is different than at least one of the saturation of the first color contributing component and the saturation of the second color contributing component by from about 90% to about 99%, or by from about 95% to about 99%, or by from about 90% to about 95%, or by from about 85% to about 90%, or by from about 80% to about 90%, or by from about 80% to about 85%, or by from about 75% to about 80%, or by from about 70% to about 80%, or by from about 65% to about 75%, or by from about 55% to about 65%, or by from about 50% to about 75%, or by from about 50% to about 55%, or by from about 45% to about 55%, or by from about 45% to about 50%, or by from about 35% to about 40%, or by from about 25% to about 35%, or by from about 25% to about 30%, or by from about 20% to about 25%, or by from about 5% to about 25%, or by from about 5% to about 15%, or by from about 5% to about 10%.

In one embodiment, the overall golf ball chroma is different than at least one of the chroma of the first color contributing component and the chroma of the second color contributing component by less than about 100%, or by less than about 99%, or by less than about 95%, or by less than about 90%, or by less than about 85%, or by less than about 80%, or by less than about 75%, or by less than about 70%, or by less than about 65%, or by less than about 60%, or by less than about 55%, or by less than about 50%, or by less than about 45%, or by less than about 40%, or by less than about 35%, or by less than about 30%, or by less than about 25%, or by less than about 20%, or by less than about 15%, or by less than about 10%.

In another embodiment, the overall golf ball chroma is different than at least one of the chroma of the first color contributing component and the chroma of the second color contributing component by from about 95% to about 99%, or by from about 90% to about 99%, or by from about 85% to about 95%, or by from about 75% to about 90%, or by from about 70% to about 85%, or by from about 50% to about 75%, or by from about 45% to about 65%, or by from about 35% to about 50%, or by from about 25% to about 35%, or by from about 25% to about 30%, or by from about 15% to about 30%, or by from about 15% to about 25%, or by from about 10% to about 25%, or by from about 10% to about 20%, or by from about 5% to about 50%, or by from about 5% to about 25%.

In yet another embodiment, the overall golf ball chroma is different than at least one of the chroma of the first color contributing component and the chroma of the second color contributing component by at least about 5%, or by at least about 10%, or by at least about 15%, or by at least about 20%, or by at least about 25%, or by at least about 50%, or by at least about 75%, or by at least about 80%, or by at least about 90%, or by at least about 95%, or by at least about 99%.

In one embodiment, the overall golf ball saturation is different than at least one of the saturation of the first color contributing component and the saturation of the second color contributing component by at least about 95%, and the overall golf ball chroma is different than at least one of the chroma of the first color contributing component and the chroma of the second color contributing component by at least about 25%. In yet another embodiment, the overall golf ball saturation is different than at least one of the saturation of the first color contributing component and the saturation of the second color contributing component by at least about 90%, and the overall golf ball chroma is different than at least one of the chroma of the first color contributing component and the chroma of the second color contributing component by at least about 25%. In still another embodiment, the overall golf ball saturation is different than at least one of the saturation of the first color contributing component and the saturation of the second color contributing component by at least about 85%, and the overall golf ball chroma is different than at least one of the chroma of the first color contributing component and the chroma of the second color contributing component by at least about 25%. In a different embodiment, the overall golf ball saturation is different than at least one of the saturation of the first color contributing component and the saturation of the second color contributing component by at least about 80%, and the overall golf ball chroma is different than at least one of the chroma of the first color contributing component and the chroma of the second color contributing component by at least about 25%. Alternatively, the overall golf ball saturation may be different than at least one of the saturation of the first color contributing component and the saturation of the second color contributing component by at least about 75%, and the overall golf ball chroma is different than at least one of the chroma of the first color contributing component and the chroma of the second color contributing component by at least about 25%. Also, the overall golf ball saturation may be different than at least one of the saturation of the first color contributing component and the saturation of the second color contributing component by at least about 50%, and the overall golf ball chroma is different than at least one of the chroma of the first color contributing component and the chroma of the second color contributing component by at least about 25%. In one embodiment, the overall golf ball saturation is different than at least one of the saturation of the first color contributing component and the saturation of the second color contributing component by at least about 40%, and the overall golf ball chroma is different than at least one of the chroma of the first color contributing component and the chroma of the second color contributing component by at least about 20%. In a further embodiment, the overall golf ball saturation is different than at least one of the saturation of the first color contributing component and the saturation of the second color contributing component by at least about 25%, and the overall golf ball chroma is different than at least one of the chroma of the first color contributing component and the chroma of the second color contributing component by at least about 25%.

In one embodiment, the overall golf ball saturation is different than at least one of the saturation of the first color contributing component and the saturation of the second color contributing component by from about 85% to less than 100%, and the overall golf ball chroma is different than at least one of the chroma of the first color contributing component and the chroma of the second color contributing component by from about 15% to about 50%. In yet another embodiment, the overall golf ball saturation is different than at least one of the saturation of the first color contributing component and the saturation of the second color contributing component by from about 85% to less than 100%, and the overall golf ball chroma is different than at least one of the chroma of the first color contributing component and the chroma of the second color contributing component by from about 50% to about 75%. In still another embodiment, the overall golf ball saturation is different than at least one of the saturation of the first color contributing component and the saturation of the second color contributing component by from about 50% to about 85%, and the overall golf ball chroma is different than at least one of the chroma of the first color contributing component and the chroma of the second color contributing component by from about 15% to about 50%. In a different embodiment, the overall golf ball saturation is different than at least one of the saturation of the first color contributing component and the saturation of the second color contributing component by from about 50% to about 85%, and the overall golf ball chroma is different than at least one of the chroma of the first color contributing component and the chroma of the second color contributing component by from about 50% to about 75%. Alternatively, the overall golf ball saturation may be different than at least one of the saturation of the first color contributing component and the saturation of the second color contributing component by from about 25% to about 50%, and the overall golf ball chroma is different than at least one of the chroma of the first color contributing component and the chroma of the second color contributing component by from about 15% to about 50%. Also, the overall golf ball saturation may be different than at least one of the saturation of the first color contributing component and the saturation of the second color contributing component by from about 15% to about 50%, and the overall golf ball chroma is different than at least one of the chroma of the first color contributing component and the chroma of the second color contributing component by from about 50% to about 75%. In one embodiment, the overall golf ball saturation is different than at least one of the saturation of the first color contributing component and the saturation of the second color contributing component by from about 35% to about 65%, and the overall golf ball chroma is different than at least one of the chroma of the first color contributing component and the chroma of the second color contributing component by from about 35% to about 75%. In a further embodiment, the overall golf ball saturation is different than at least one of the saturation of the first color contributing component and the saturation of the second color contributing component by from about 5% to about 35%, and the overall golf ball chroma is different than at least one of the chroma of the first color contributing component and the chroma of the second color contributing component by from about 5% to about 35%.

An embodiment is also envisioned wherein the hue and saturation and a chroma of each color contributing component contributes to an overall golf ball hue, saturation and chroma such that: the overall golf ball hue is substantially similar to the hue of the first color contributing component and substantially similar to the hue of the second color contributing component; the overall golf ball saturation is different than the saturation of the first color contributing component and the saturation of the second color contributing component; and the overall golf ball chroma is different than the chroma of the first color contributing component and the chroma of the second color contributing component.

A golf ball of the invention may also comprise a core, a cover disposed about the core and a coating formed on an outer surface of the cover; wherein the core comprises at least one layer comprising a first color contributing component and wherein the cover comprises at least one layer comprising a second color contributing component. The first color contributing component comprises a colorant that contributes to an overall golf ball color, and the second color contributing component comprises a colorant that contributes to the overall golf ball color. The first color contributing component has a hue that is substantially similar to a hue of the second color contributing component. The first color contributing component further has a saturation that is different than a saturation of the second color contributing component. Meanwhile, the coating comprises a third color contributing component comprising a colorant that contributes to an overall golf ball color, the third color contributing component having a hue that is substantially similar to the hue of the first color contributing component and the hue of the second color contributing component. The third color contributing component also has a saturation greater than the saturation of the first color contributing component and the saturation of the second color contributing component such that an overall golf ball saturation is substantially similar to the saturation of the first color contributing component or the saturation of the second color contributing component, and such that an overall golf ball chroma is different than a chroma of the first color contributing component and a chroma of the second color contributing component.

Alternatively, the golf ball may comprise a core, a cover disposed about the core and a coating formed on an outer surface of the cover; wherein the core comprises at least one layer comprising a first color contributing component and wherein the cover comprises at least one layer comprising a second color contributing component. The first color contributing component comprising a colorant that contributes to an overall golf ball color, and the second color contributing component comprises a colorant that contributes to the overall golf ball color. The first color contributing component has a hue that is substantially similar to a hue of the second color contributing component and the first color contributing component further has a saturation that is different than a saturation of the second color contributing component. Meanwhile, the coating comprises a third color contributing component comprising a colorant that contributes to an overall golf ball color, the third color contributing component having a saturation less than the saturation of the first color contributing component and the saturation of the second color contributing component such that the overall golf ball saturation is substantially similar to the saturation of the first color contributing component or the saturation of second color contributing component, and such that an overall golf ball chroma is different than a chroma of the first color contributing component and a chroma of the second color contributing component.

In one embodiment, the golf ball comprises a core comprising at least one layer A, a cover comprising at least one layer B, optionally an intermediate layer C disposed between the core and the cover, and optionally a coating D applied on an outermost surface of the golf ball. At least two of layer A, layer B, layer C and coating D comprise a golf ball color contributing component comprising a color $K_1$, $K_2$, $K_n$ and contributing to an overall golf ball color, wherein n is the number of golf ball color contributing components. In this regard, $K_1$ has a hue $H_1$ and a saturation $S_1$; $K_2$ has a hue $H_2$ and a saturation $S_2$; and $K_n$ has a hue $H_n$ and a saturation $S_n$ such that: $H_1=H_2=H_n$ and at least two of $S_1$, $S_2$, and $S_n$ are different. The hue, saturation and a chroma of each color contributing component contributes to an overall golf ball hue, saturation and chroma such that: the overall golf ball hue is substantially similar to the hue of each color contributing component; the overall golf ball saturation is different than the saturation of at least one color contributing component; and the overall golf ball chroma is different than the chroma of at least one color contributing component.

In one embodiment, the saturation of at least two of $S_1$, $S_2$, $S_n$ differ by at least about 99%, or by at least about 95%, or by at least about 90%, or by at least about 88%, or by at least about 85%, or by at least about 82%, or by at least about 80%, or by at least about 75%, or by at least about 70%, or by at least about 65%, or by at least about 60%, or by at least about 55%, or by at least about 50%, or by at least about 45%, or by at least about 40%, or by at least about 35%, or by at least about 30%, or by at least about 25%, or by at least about 20%, or by at least about 15%, or by at least about 10%, or by at least about 5%.

In another embodiment, the saturation of at least two of $S_1$, $S_2$, $S_n$ differ by less than about 100%, or by less than about 95%, or by less than about 90%, or by less than about 85%, or by less than about 80%, or by less than about 75%, or by less than about 70%, or by less than about 65%, or by less than about 60%, or by less than about 55%, or by less than about 50%, or by less than about 45%, or by less than about 40%, or by less than about 35%, or by less than about 30%, or by less than about 25%, or by less than about 20%, or by less than about 15%, or by less than about 10%.

The overall golf ball saturation may be different than the saturation of at least one of $S_1$, $S_2$, $S_n$ by at least about 10%, or by at least about 15%, or by at least about 25%, or by at least about 34%, or by at least about 42%, or by at least about 51%, or by at least about %, or by at least about 57%, or by at least about %, or by at least about 63%, or by at least about 68%, or by at least about 74%, or by at least about %, or by at least about 81%, or by at least about 88%, or by at least about 92%, or by at least about 96%, or by at least about 99%.

Alternatively, the overall golf ball saturation may be different than the saturation of at least one of $S_1$, $S_2$, $S_n$ by greater than about 5% and less than about 15%, or by greater than about 10% and less than about 25%, or by greater than about 20% and less than about 35%, or by greater than about 30% and less than about 35%, or by greater than about 20% and less than about 50%, or by greater than about 45% and less than about 55%, or by greater than about 50% and less than about 60%, or by greater than about 55% and less than about 70%, or by greater than about 65% and less than about 75%, or by greater than about 70% and less than about 85%, or by greater than about 75% and less than about 90%, or by greater than about 85% and less than about 92% by greater than about 90% and less than about 96%, or by greater than about 95% and less than about 100%, or by greater than about 98% and less than about 100%.

The overall golf ball chroma may be different than the chroma of at least one color contributing component by from about 2% to about 7%, or by from about 5% to about 12%, or by from about 9% to about 17%, or by from about 10% to about 25%, or by from about 15% to about 25%, or by from about 20% to about 35%, or by from about 35% to about 50%, or by from about 50% to about 65%, or by from about 60% to about 70%, or by from about 65% to about 75%, or by from about 70% to about 85%, or by from about 85% to about 90%, or by from about 90% to about 94%, or by from about 92 to about 97%, or by from about 95% to about 98%, or by from about 96% to about 99%.

In one embodiment, the overall golf ball saturation is different than the saturation of at least one of $S_1$, $S_2$, $S_n$ by at least about 95% and the overall chroma is different than the chroma of at least one color contributing component by at least 50%. In another embodiment, the overall golf ball saturation is different than the saturation of at least one of $S_1$, $S_2$, $S_n$ by at least about 90% and the overall chroma is different than the chroma of at least one color contributing component by at least 45%. In yet another embodiment, the overall golf ball saturation is different than the saturation of at least one of $S_1$, $S_2$, $S_n$ by at least about 85% and the overall chroma is different than the chroma of at least one color contributing component by at least 35%. In still another embodiment, the overall golf ball saturation is different than the saturation of at least one of $S_1$, $S_2$, $S_n$ by at least about 75% and the overall chroma is different than the chroma of at least one color contributing component by at least 25%. In a different embodiment, the overall golf ball saturation is different than the saturation of at least one of $S_1$, $S_2$, $S_n$ by at least about 50% and the overall chroma is different than the chroma of at least one color contributing component by at least 50%. Alternatively, the overall golf ball saturation is different than the saturation of at least one of $S_1$, $S_2$, $S_n$ by at least about 35% and the overall chroma is different than the chroma of at least one color contributing component by at least 45%.

Also, the overall golf ball saturation may be different than the saturation of at least one of $S_1$, $S_2$, $S_n$ by at least about 25% and the overall chroma may meanwhile be different than the chroma of at least one color contributing component by at least 50%. Meanwhile, in another embodiment, the overall golf ball saturation may be different than the saturation of at least one of $S_1$, $S_2$, $S_n$ by at least about 15% and the overall chroma may be different than the chroma of at least one color contributing component by at least 45%. In yet another embodiment, the overall golf ball saturation is different than the saturation of at least one of $S_1$, $S_2$, $S_n$ by at least about 15% and the overall chroma is different than the chroma of at least color contributing component by at least 15%.

In yet another embodiment, the golf ball comprises a core comprising at least one layer A, a cover comprising at least one layer B, optionally an intermediate layer C disposed between the core and the cover, and optionally a coating D applied on an outermost surface of the golf ball. Layer A and at least one of layer B, layer C and coating D each comprise a golf ball color contributing component comprising a color $K_1$, $K_2$, $K_n$ and contributing to an overall golf ball color wherein n is the number of golf ball color contributing components. In this regard, $K_1$ has a hue $H_1$ and a saturation $S_1$; $K_2$ has a hue $H_2$ and a saturation $S_2$; and $K_n$ has a hue $H_n$ and a saturation $S_n$ such that: $H_1=H_2<H_n$ and at least two of $S_1$, $S_2$, and $S_n$ are different. The hue, saturation and a chroma of each color contributing component contributes to an overall golf ball hue, saturation and chroma such that: the overall golf ball hue is substantially similar to the hue of each color contributing component; the overall golf ball saturation is different than the saturation of at least one color contributing component; and the overall golf ball chroma is different than the chroma of at least one color contributing component.

In still another embodiment, the golf ball comprises a core comprising at least one layer A, a cover comprising at least one layer B, optionally an intermediate layer C disposed between the core and the cover, and optionally a coating D applied on an outermost surface of the golf ball. Coating D and at least one of layer A, layer B, and layer C each comprise a golf ball color contributing component comprising a color $K_1$, $K_2$, $K_n$ and contributing to an overall golf ball color wherein n is the number of golf ball color contributing components. In this regard, $K_1$ has a hue $H_1$ and a saturation $S_1$; $K_2$ has a hue $H_2$ and a saturation $S_2$; and $K_n$ has a hue $H_n$ and a saturation $S_n$ such that: $H_1=H_2=H_n$ and at least two of $S_1$, $S_2$, and $S_n$ are different. The hue, saturation and a chroma of each color contributing component contributes to an overall golf ball hue, saturation and chroma such that: the overall golf ball hue is substantially similar to the hue of each color contributing component; the overall golf ball saturation is different than the saturation of at least one color contributing component; and the overall golf ball chroma is different than the chroma of at least one color contributing component.

In a different embodiment, the golf ball comprises a core comprising at least one layer A, a cover comprising at least one layer B, optionally an intermediate layer C disposed between the core and the cover, and optionally a coating D applied on an outermost surface of the golf ball. Layer B and at least one of layer A, layer C and coating D comprise a golf ball color contributing component comprising a color $K_1$, $K_2$, $K_n$ and contributing to an overall golf ball color wherein n is the number of golf ball color contributing components. In this regard, $K_1$ has a hue $H_1$ and a saturation $S_1$; $K_2$ has a hue $H_2$ and a saturation $S_2$; and $K_n$ has a hue $H_n$ and a saturation $S_n$ such that: $H_1=H_2=H_n$ and at least two of $S_1$, $S_2$, and $S_n$ are different. The hue, saturation and a chroma of each color contributing component contributes to an overall golf ball hue, saturation and chroma such that: the overall golf ball hue is substantially similar to the hue of each color contributing component; the overall golf ball saturation is different than the saturation of at least one color contributing component; and the overall golf ball chroma is different than the chroma of at least one color contributing component.

Herein, when referring to the saturation of one golf ball color contributing component differing from the saturation of another golf ball contributing component or an overall golf ball saturation "by at least about X %" or "by greater than about X %" or by "from about to about X %", etc., this shall mean the percentage point difference in the degree of saturation as between the two golf ball color contributing components. Accordingly, where one color contributing component has 50% saturation and another component (or overall golf ball) has 90% saturation, then the difference is 40%.

Herein, when referring to the chroma of one golf ball color contributing component differing from the chroma of another golf ball contributing component or an overall golf ball chroma "by at least about X %" or "by greater than about X %" or by "from about to about X %", etc., this shall mean that one differs by the other by X %. Accordingly, if the chroma of two color contributing components are measured, for example, in CIE Lab, as 35 and 58 respectively, then they are (((58−35)/58)*100%) different.

The first color contributing component may further comprise an interference effect pigment such that the overall golf ball saturation is greater than the saturation of the first color contributing component and the saturation of the second color contributing component and wherein the overall golf ball chroma is greater than the chroma of the first color contributing component and the chroma of the second color contributing component.

In one embodiment, the second color contributing component further comprises an interference effect pigment such that the overall golf ball saturation is greater than the saturation of the first color contributing component and the saturation of the second color contributing component and wherein the overall golf ball chroma is greater than the chroma of the first color contributing component and the chroma of the second color contributing component.

In another embodiment, a golf ball of the invention comprises a core and a cover disposed about the core wherein the core comprises at least one layer comprising a first color contributing component, the cover comprises at least one layer comprising a second color contributing component, and the cover further incorporates a color effect pigment comprising a third color contributing component. The first, second and third color contributing components each comprise a colorant that contributes to an overall golf ball color. The first color contributing component has a hue that is substantially similar to a hue of the second and third color contributing components. Meanwhile, the saturation of the first color contributing component is different than the saturations of both the second and third color contributing components. The hue, saturation and a chroma of the first, second and third color contributing components each contribute to an overall golf ball hue, saturation and chroma such that: the overall golf ball hue is substantially similar to the hue of the first, second and third color contributing components; the overall golf ball saturation is different than the saturation of at least one of the first, second and third color contributing components; and the overall golf ball chroma is different than at least one of the chroma of the first, second and third color contributing components.

It is understood that the embodiments above incorporating an interference effect pigment as a color contributing component in golf balls of the invention serve as non-limiting examples.

DETAILED DESCRIPTION

The cores in golf balls of this invention may be solid, semi-solid, hollow, fluid-filled, or powder-filled. Typically, the cores are solid and made from rubber compositions containing at least a base rubber, free-radical initiator agent, cross-linking co-agent, and fillers. Golf balls having various constructions may be made in accordance with this invention. For example, golf balls having three-piece, four-piece, and five-piece constructions with dual or three-layered cores and cover materials may be made. More particularly, in one version, a three-piece golf ball comprising a center and a "dual-cover" is made. In another version, a four-piece golf ball comprising a dual-core and "dual-cover" is made. The dual-core includes an inner core (center) and surrounding outer core layer. The dual-cover includes inner cover and outer cover layers. In yet another construction, a five-piece golf ball having a dual-core, intermediate layer, and dual-cover is made. In still another embodiment, a four piece golf ball comprises a core and a three layer cover.

As used herein, the term, "intermediate layer" means a layer of the golf ball disposed between the core (center or outer core layer) and cover. The intermediate layer may be considered an outer core layer, or inner cover layer, or any other layer disposed between the inner core and outer cover of the ball. The diameter and thickness of the different layers along with properties such as hardness and compression may vary depending upon the construction and desired playing performance properties of the golf ball and as specified herein.

The inner core of the golf ball may comprise a polybutadiene rubber material. In one embodiment, the ball contains a single core formed of the polybutadiene rubber composition. In a second embodiment, the ball contains a dual-core comprising an inner core (center) and surrounding outer core layer. In yet another version, the golf ball contains a multi-layered core comprising an inner core, intermediate core layer, and outer core layer.

In general, polybutadiene is a homopolymer of 1,3-butadiene. Any suitable catalyst may be used to synthesize the polybutadiene rubber depending upon the desired properties. Normally, a transition metal complex (for example nickel, or cobalt), a rare earth metal such as neodymium or an alkyl metal such as alkyllithium is used as a catalyst. Other catalysts include, but are not limited to, aluminum, boron, lithium, titanium, and combinations thereof. The catalysts produce polybutadiene rubbers having different chemical structures. In a cis-bond configuration, the main internal polymer chain of the polybutadiene appears on the same side of the carbon-carbon double bond contained in the polybutadiene. In a trans-bond configuration, the main internal polymer chain is on opposite sides of the internal carbon-carbon double bond in the polybutadiene. The polybutadiene rubber can have various combinations of cis- and trans-bond structures. A preferred polybutadiene rubber has a 1,4 cis-bond content of at least 40%, preferably greater than 80%, and more preferably greater than 90%. In general, highly crosslinked polybutadiene rubbers having a high 1,4 cis-bond content have high tensile strength. The polybutadiene rubber may have a relatively high or low Mooney viscosity.

Examples of commercially available polybutadiene base rubbers that can be used in accordance with this invention, include, but are not limited to, BR 01 and BR 1220, available from BST Elastomers of Bangkok, Thailand; SE BR 1220LA and SE BR1203, available from DOW Chemical Co of Midland, Mich.; BUDENE 1207, 1207s, 1208, and 1280 available from Goodyear, Inc of Akron, Ohio; BR 01, 51 and 730, available from Japan Synthetic Rubber (JSR) of Tokyo, Japan; BUNA CB 21, CB 22, CB 23, CB 24, CB 25, CB 29 MES, CB 60, CB Nd 60, CB 55 NF, CB 70 B, CB KA 8967, and CB 1221, available from Lanxess Corp. of Pittsburgh. Pa.; BR1208, available from LG Chemical of Seoul, South Korea; UBEPOL BR130B, BR150, BR150B, BR150L, BR230, BR360L, BR710, and VCR617, available from UBE Industries, Ltd. of Tokyo, Japan; EUROPRENE NEOCIS BR 60, INTENE 60 AF and P30AF, and EUROPRENE BR HV80, available from Polimeri Europa of Rome, Italy; AFDENE 50 and NEODENE BR40, BR45, BR50 and BR60, available from Karbochem (PTY) Ltd. of Bruma, South Africa; KBR 01, NdBr 40, NdBR-45, NdBr 60, KBR 710S, KBR 710H, and KBR 750, available from Kumho Petrochemical Co., Ltd. Of Seoul, South Korea; DIENE 55NF, 70AC, and 320 AC, available from Firestone Polymers of Akron, Ohio; and PBR-Nd Group II and Group III, available from Nizhnekamskneftekhim, Inc. of Nizhnekamsk, Tartarstan Republic.

Other suitable polybutadiene base rubbers include BUNA® CB22, BUNA® CB23 and BUNA® CB24, BUNA® 1203G1, 1220, 1221, and BUNA® CBNd-40, commercially available from LANXESS Corporation; BSTE BR-1220 available from BST Elastomers Co. LTD; UBEPOL® 360L and UBEPOL® 150L and UBEPOL-BR rubbers, commercially available from UBE Industries, Ltd. of Tokyo, Japan; Budene 1207, 1208 and 1280, commercially available from Goodyear of Akron, Ohio; SE BR-1220, commercially available from Dow Chemical Company; Europrene® NEOCIS® BR 40 and BR 60, commercially available from Polimeri Europa; and BR 01, BR 730, BR 735, BR 11, and BR 51, commercially available from Japan Synthetic Rubber Co., Ltd; and NEODENE 40, 45, and 60, commercially available from Karbochem.

Still other suitable base rubbers may include polyisoprene rubber, natural rubber, ethylene-propylene rubber, ethylene-propylene diene rubber, styrene-butadiene rubber, and combinations of two or more thereof. Another preferred base rubber is polybutadiene optionally mixed with one or more elastomers such as polyisoprene rubber, natural rubber, ethylene propylene rubber, ethylene propylene diene rubber, styrene-butadiene rubber, polystyrene elastomers, polyethylene elastomers, polyurethane elastomers, polyurea elastomers, acrylate rubbers, polyoctenamers, metallocene-catalyzed elastomers, and plastomers. As discussed further below, highly neutralized acid copolymers (HNPs), as known in the art, also can be used to form the core layer as part of the blend. Such compositions will provide increased flexural modulus and toughness thereby improving the golf ball's performance including its impact durability.

The base rubbers may be blended with each other and typically may be mixed with at least one reactive cross-linking co-agent to enhance the hardness of the rubber composition. Suitable co-agents include, but are not limited to, unsaturated carboxylic acids and unsaturated vinyl compounds. A preferred unsaturated vinyl compound is trimethylolpropane trimethacrylate. The rubber composition is cured using a conventional curing process. Suitable curing processes include, for example, peroxide curing, sulfur curing, high-energy radiation, and combinations thereof. In one embodiment, the base rubber is peroxide cured. Organic peroxides suitable as free-radical initiators include, for example, dicumyl peroxide; n-butyl-4,4-di(t-butylperoxy)valerate; 1,1-di(t-butylperoxy)3,3,5-trimethylcyclohexane; 2,5-dimethyl-2,5-di(t-butylperoxy)hexane; di-t-butyl peroxide; di-t-amyl peroxide; t-butyl peroxide; t-butyl cumyl peroxide; 2,5-dimethyl-2,5-di(t-butylperoxy)hexyne-3; di(2-t-butylperoxyisopropyl)benzene; dilauroyl peroxide; dibenzoyl peroxide; t-butyl hydroperoxide; and combinations thereof. Cross-linking co-agents are used to cross-link at least a portion of the polymer chains in the composition. Suitable cross-linking co-agents include, for example, metal salts of unsaturated carboxylic acids having from 3 to 8 carbon atoms; unsaturated vinyl compounds and polyfunctional monomers (for example, trimethylolpropane trimethacrylate); phenylene bismaleimide; and combinations thereof. In a particular embodiment, the cross-linking co-agent is selected from zinc salts of acrylates, diacrylates, methacrylates, and dimethacrylates. In another particular embodiment, the cross-linking co-agent is zinc diacrylate ("ZDA"). Commercially available zinc diacrylates include those selected from Cray Valley or Resource Innovations Inc. Other elastomers known in the art may also be added, such as other polybutadiene rubbers, natural rubber, styrene butadiene rubber, and/or isoprene rubber in order to further modify the properties of the core. When a mixture of elastomers is used, the amounts of other constituents in the core composition are typically based on 100 parts by weight of the total elastomer mixture.

Thermoplastic elastomers (TPE) may also be used to modify the properties of the core layers, or the uncured core layer stock by blending with the uncured rubber. These TPEs include natural or synthetic balata, or high trans-polyisoprene, high trans-polybutadiene, or any styrenic block copolymer, such as styrene ethylene butadiene styrene, styrene-isoprene-styrene, etc., a metallocene or other single-site catalyzed polyolefin such as ethylene-octene, or ethylene-butene, or thermoplastic polyurethanes (TPU), including copolymers, e.g. with silicone. Other suitable TPEs for blending with the thermoset rubbers of the present invention include PEBAX®, which is believed to comprise polyether amide copolymers, HYTREL®, which is believed to comprise polyether ester copolymers, thermoplastic urethane, and KRATON®, which is believed to comprise styrenic block copolymer elastomers. Any of the TPEs or TPUs above may also contain functionality suitable for grafting, including maleic acid or maleic anhydride. Any of the Thermoplastic Vulcanized Rubbers (TPV) such as Santoprene® or Vibram® or ETPV® can be used along with a present invention. In one embodiment, the TPV has a thermoplastic as a continuous phase and a cross-linked rubber particulate as a dispersed (or discontinuous) phase. In another embodiment, the TPV has a cross-linked phase as a continuous phase and a thermoplastic as a dispersed (or discontinuous) phase to provide reduced loss in elasticity in order to improve the resiliency of the golf ball.

The rubber compositions also may contain "soft and fast" agents such as a halogenated organosulfur, organic disulfide, or inorganic disulfide compounds. Particularly suitable halogenated organosulfur compounds include, but are not limited to, halogenated thiophenols. Preferred organic sulfur compounds include, but not limited to, pentachlorothiophenol ("PCTP") and a salt of PCTP. A preferred salt of PCTP is ZnPCTP. A suitable PCTP is sold by the Struktol Company (Stow, Ohio) under the tradename, A95. ZnPCTP is commercially available from EchinaChem (San Francisco, Calif.). These compounds also may function as cis-to-trans catalysts to convert some cis bonds in the polybutadiene to trans bonds. Antioxidants also may be added to the rubber compositions to prevent the breakdown of the elastomers. Other ingredients such as accelerators (for example, tetramethylthiuram sulfides), processing aids, dyes and pigments, wetting agents, surfactants, plasticizers, as well as other additives known in the art may be added to the rubber composition.

The core may be formed by mixing and forming the rubber composition using conventional techniques. These cores can be used to make finished golf balls by surrounding the core with outer core layer(s), intermediate layer(s), and/or cover materials as discussed further below. In another embodiment, the cores can be formed using highly neutralized polymer (HNP) compositions as disclosed in U.S. Pat. Nos. 6,756,436, 7,030,192, 7,402,629, and 7,517,289. The cores from the highly neutralized polymer compositions can be further cross-linked using any free-radical initiation sources including radiation sources such as gamma or electron beam as well as chemical sources such as peroxides and the like.

Golf balls made in accordance with this invention can be of any size, although the USGA requires that golf balls used in competition have a diameter of at least 1.68 inches and a weight of no greater than 1.62 ounces. For play outside of USGA competition, the golf balls can have smaller diameters and be heavier.

A wide variety of thermoplastic or thermosetting materials can be employed in forming the center, core layer(s), intermediate layer(s), and/or cover layer(s). These materials include for example, grafted polyolefins such as Fusabond®525D or olefin-based copolymer ionomer resins for example, Surlyn® ionomer resins and DuPont® HPF 1000 and HPF 2000, as well as blends of Surlyn®7940/Surlyn®8940 or Surlyn®8150/Surlyn®9150, all commercially available from E. I. du Pont de Nemours and Company; Iotek® ionomers, commercially available from ExxonMobil Chemical Company; Amplify® IO ionomers of ethylene acrylic acid copolymers, commercially available from The Dow Chemical Company; and Clarix® ionomer resins, commercially available from A. Schulman Inc.; polyurethanes; polyureas; copolymers and hybrids of polyurethane and polyurea; polyethylene, including, for example, low density polyethylene, linear low density polyethylene, and high density polyethylene; polypropylene; rubber-toughened olefin polymers; acid polymers, for example, poly(meth)acrylic acid, which do not become part of an ionomeric copolymer; plastomers; flexomers; styrene-butadiene-styrene block copolymers; styrene-ethylene-butylene-styrene block copolymers; dynamically vulcanized elastomers; copolymers of ethylene and vinyl acetates; copolymers of ethylene and methyl acrylates; polyvinyl chloride resins; polyamides, poly(amide-ester) elastomers, and graft copolymers of ionomer and polyamide including, for example, Pebax® thermoplastic polyether block amides, commercially available from Arkema Inc; cross-linked trans-polyisoprene and blends thereof; polyester-based thermoplastic elastomers, such as Hytrel®, commercially available from E. I. du Pont de Nemours and Company; polyurethane-based thermoplastic elastomers, such as Elastollan®, commercially available from BASF; synthetic or natural vulcanized rubber; and combinations thereof.

In fact, any of the core, intermediate layer and/or cover layers may include the following materials:

(1) Polyurethanes, such as those prepared from polyols and diisocyanates or polyisocyanates and/or their prepolymers;

(2) Polyureas; and (3) Polyurethane-urea hybrids, blends or copolymers comprising urethane and urea segments.

Suitable polyurethane compositions comprise a reaction product of at least one polyisocyanate and at least one curing agent. The curing agent can include, for example, one or more polyamines, one or more polyols, or a combination thereof. The polyisocyanate can be combined with one or more polyols to form a prepolymer, which is then combined with the at least one curing agent. Thus, the polyols described herein are suitable for use in one or both components of the polyurethane material, i.e., as part of a prepolymer and in the curing agent. Suitable polyurethanes are described in U.S. Patent Application Publication No. 2005/0176523, which is incorporated by reference in its entirety.

Any polyisocyanate available to one of ordinary skill in the art is suitable for use according to the invention. Exemplary polyisocyanates include, but are not limited to, 4,4'-diphenylmethane diisocyanate (MDI); polymeric MDI; carbodiimide-modified liquid MDI; 4,4'-dicyclohexylmethane diisocyanate ($H_{12}$MDI); p-phenylene diisocyanate (PPDI); m-phenylene diisocyanate (MPDI); toluene diisocyanate (TDI); 3,3'-dimethyl-4,4'-biphenylene diisocyanate; isophoronediisocyanate; 1,6-hexamethylene diisocyanate (HDI); naphthalene diisocyanate; xylene diisocyanate; p-tetramethylxylene diisocyanate; m-tetramethylxylene diisocyanate; ethylene diisocyanate; propylene-1,2-diisocyanate; tetramethylene-1,4-diisocyanate; cyclohexyl diisocyanate; dodecane-1,12-diisocyanate; cyclobutane-1,3-diisocyanate; cyclohexane-1,3-diisocyanate; cyclohexane-1,4-diisocyanate; 1-isocyanato-3,3,5-trimethyl-5-isocyanatomethylcyclohexane; methyl cyclohexylene diisocyanate; triisocyanate of HDI; triisocyanate of 2,4,4-trimethyl-1,6-hexane diisocyanate; tetracene diisocyanate; napthalene diisocyanate; anthracene diisocyanate; isocyanurate of toluene diisocyanate; uretdione of hexamethylene diisocyanate; and mixtures thereof. Polyisocyanates are known to those of ordinary skill in the art as having more than one isocyanate group, e.g., di-isocyanate, tri-isocyanate, and tetra-isocyanate. Preferably, the polyisocyanate includes MDI, PPDI, TDI, or a mixture thereof, and more preferably, the polyisocyanate includes MDI. It should be understood that, as used herein, the term MDI includes 4,4'-diphenylmethane diisocyanate, polymeric MDI, carbodiimide-modified liquid MDI, and mixtures thereof. Additionally, the prepolymers synthesized from these diisocyanates may be "low free monomer," understood by one of ordinary skill in the art to have lower levels of "free" isocyanate monomers, typically less than about 0.1% free isocyanate. Examples of "low free monomer" prepolymers include, but are not limited to Low Free Monomer MDI prepolymers, Low Free Monomer TDI prepolymers, and Low Free Monomer PPDI prepolymers.

Any polyol available to one of ordinary skill in the art is suitable for use according to the invention. Exemplary polyols include, but are not limited to, polyether polyols, hydroxy-terminated polybutadiene (including partially/fully hydrogenated derivatives), polyester polyols, polycaprolactone polyols, and polycarbonate polyols. In one preferred embodiment, the polyol includes polyether polyol. Examples include, but are not limited to, polytetramethylene ether glycol (PTMEG), polyethylene propylene glycol, polyoxypropylene glycol, and mixtures thereof. The hydrocarbon chain can have saturated or unsaturated bonds and substituted or unsubstituted aromatic and cyclic groups. Preferably, the polyol of the present invention includes PTMEG.

In another embodiment, polyester polyols are included in the polyurethane material. Suitable polyester polyols include, but are not limited to, polyethylene adipate glycol; polybutylene adipate glycol; polyethylene propylene adipate glycol; o-phthalate-1,6-hexanediol; poly(hexamethylene adipate)glycol; and mixtures thereof. The hydrocarbon chain can have saturated or unsaturated bonds, or substituted or unsubstituted aromatic and cyclic groups.

In another embodiment, polycaprolactone polyols are included in the materials of the invention. Suitable polycaprolactone polyols include, but are not limited to, 1,6-hexanediol-initiated polycaprolactone, diethylene glycol initiated polycaprolactone, trimethylol propane initiated polycaprolactone, neopentyl glycol initiated polycaprolactone, 1,4-butanediol-initiated polycaprolactone, and mixtures thereof. The hydrocarbon chain can have saturated or unsaturated bonds, or substituted or unsubstituted aromatic and cyclic groups.

In yet another embodiment, polycarbonate polyols are included in the polyurethane material of the invention. Suitable polycarbonates include, but are not limited to, polyphthalate carbonate and poly(hexamethylene carbonate)glycol. The hydrocarbon chain can have saturated or unsaturated bonds, or substituted or unsubstituted aromatic and cyclic groups. In one embodiment, the molecular weight of the polyol is from about 200 to about 4000.

Polyamine curatives are also suitable for use in the polyurethane composition of the invention and have been found to improve cut, shear, and impact resistance of the resultant balls. Preferred polyamine curatives include, but are not limited to, 3,5-dimethylthio-2,4-toluenediamine and isomers thereof; 3,5-diethyltoluene-2,4-diamine and isomers thereof, such as 3,5-diethyltoluene-2,6-diamine; 4,4'-bis-(sec-butylamino)-diphenylmethane; 1,4-bis-(sec-butylamino)-benzene, 4,4'-methylene-bis-(2-chloroaniline); 4,4'-methylene-bis-(3-chloro-2,6-diethylaniline); polytetramethyleneoxide-di-p-aminobenzoate; N,N'-dialkyldiamino diphenyl methane; p,p'-methylene dianiline; m-phenylenediamine; 4,4'-methylene-bis-(2-chloroaniline); 4,4'-methylene-bis-(2,6-diethylaniline); 4,4'-methylene-bis-(2,3-dichloroaniline); 4,4'-diamino-3,3'-diethyl-5,5'-dimethyl diphenylmethane; 2,2',3,3'-tetrachloro diamino diphenylmethane; trimethylene glycol di-p-aminobenzoate; and mixtures thereof. Preferably, the curing agent of the present invention includes 3,5-dimethylthio-2,4-toluenediamine and isomers thereof, such as ETHACURE® 300, commercially available from Albermarle Corporation of Baton Rouge, La. Suitable polyamine curatives, which include both primary and secondary amines, preferably have molecular weights ranging from about 64 to about 2000.

At least one of a diol, triol, tetraol, or hydroxy-terminated curatives may be added to the aforementioned polyurethane composition. Suitable diol, triol, and tetraol groups include ethylene glycol; diethylene glycol; polyethylene glycol; propylene glycol; polypropylene glycol; lower molecular weight polytetramethylene ether glycol; 1,3-bis(2-hydroxyethoxy) benzene; 1,3-bis-[2-(2-hydroxyethoxy)ethoxy]benzene; 1,3-bis-{2-[2-(2-hydroxyethoxy)ethoxy]ethoxy}benzene; 1,4-butanediol; 1,5-pentanediol; 1,6-hexanediol; resorcinol-di-(β-hydroxyethyl)ether; hydroquinone-di-(β-hydroxyethyl) ether; and mixtures thereof. Preferred hydroxy-terminated curatives include 1,3-bis(2-hydroxyethoxy)benzene; 1,3-bis-[2-(2-hydroxyethoxy)ethoxy]benzene; 1,3-bis-{2-[2-(2-hydroxyethoxy)ethoxy]ethoxy}benzene; 1,4-butanediol, and mixtures thereof. Preferably, the hydroxy-terminated curatives have molecular weights ranging from about 48 to 2000. It should be understood that molecular weight, as used herein, is the absolute weight average molecular weight and would be understood as such by one of ordinary skill in the art.

Both the hydroxy-terminated and amine curatives can include one or more saturated, unsaturated, aromatic, and cyclic groups. Additionally, the hydroxy-terminated and amine curatives can include one or more halogen groups. The polyurethane composition can be formed with a blend or mixture of curing agents. If desired, however, the polyurethane composition may be formed with a single curing agent.

In one embodiment of the present invention, saturated polyurethanes are used to form one or more of the cover layers.

Additionally, polyurethane can be replaced with or blended with a polyurea material.

The polyether amine may be blended with additional polyols to formulate copolymers that are reacted with excess isocyanate to form a prepolymer. In one embodiment, less than about 30 percent polyol by weight of the copolymer is blended with the saturated polyether amine. In another embodiment, less than about 20 percent polyol by weight of the copolymer, preferably less than about 15 percent by weight of the copolymer, is blended with the polyether amine. The polyols listed above with respect to the polyurethane prepolymer, e.g., polyether polyols, polycaprolactone polyols, polyester polyols, polycarbonate polyols, hydrocarbon polyols, other polyols, and mixtures thereof, are also suitable for blending with the polyether amine. The molecular weight of these polymers may be from about 200 to about 4000, but also may be from about 1000 to about 3000, and more preferably are from about 1500 to about 2500.

The polyurea composition can be formed by crosslinking a polyurea prepolymer with a single curing agent or a blend of curing agents. In one embodiment, the amine-terminated curing agent may have a molecular weight of about 64 or greater. In another embodiment, the molecular weight of the amine-curing agent is about 2000 or less. As discussed above, certain amine-terminated curing agents may be modified with a compatible amine-terminated freezing point depressing agent or mixture of compatible freezing point depressing agents Suitable amine-terminated curing agents include, but are not limited to, ethylene diamine; hexamethylene diamine; 1-methyl-2,6-cyclohexyl diamine; tetrahydroxypropylene ethylene diamine; 2,2,4- and 2,4,4-trimethyl-1,6-hexanediamine; 4,4'-bis-(sec-butylamino)-dicyclohexylmethane; 1,4-bis-(sec-butylamino)-cyclohexane; 1,2-bis-(sec-butylamino)-cyclohexane; derivatives of 4,4'-bis-(sec-butylamino)-dicyclohexylmethane; 4,4'-dicyclohexylmethane diamine; 1,4-cyclohexane-bis-(methylamine); 1,3-cyclohexane-bis-(methylamine); diethylene glycol di-(aminopropyl)ether; 2-methylpentamethylene-diamine; diaminocyclohexane; diethylene triamine; triethylene tetramine; tetraethylene pentamine; propylene diamine; 1,3-diaminopropane; dimethylamino propylamine; diethylamino propylamine; dipropylene triamine; imido-bis-propylamine; monoethanolamine, diethanolamine; 3,5-diethyltoluene-2,4-diamine; triethanolamine; monoisopropanolamine, diisopropanolamine; isophoronediamine; 4,4'-methylenebis-(2-chloroaniline); 3,5-dimethylthio-2,4-toluenediamine; 3,5-dimethylthio-2,6-toluenediamine; 3,5-diethylthio-2,4-toluenediamine; 3,5-diethylthio-2,6-toluenediamine; 4,4'-bis-(sec-butylamino)-diphenylmethane and derivatives thereof; 1,4-bis-(sec-butylamino)-benzene; 1,2-bis-(sec-butylamino)-benzene; N,N'-dialkylamino-diphenylmethane; N,N,N',N'-tetrakis(2-hydroxypropyl)ethylene diamine; trimethyleneglycol-di-p-aminobenzoate; polytetramethyleneoxide-di-p-aminobenzoate; 4,4'-methylenebis-(3-chloro-2,6-diethyleneaniline); 4,4'-methylenebis-(2,6-diethylaniline); meta-phenylenediamine; paraphenylenediamine; and mixtures thereof. In one embodiment, the amine-terminated curing agent is 4,4'-bis-(sec-butylamino)-dicyclohexylmethane.

Suitable saturated amine-terminated curing agents include, but are not limited to, ethylene diamine; hexamethylene diamine; 1-methyl-2,6-cyclohexyl diamine; tetrahydroxypropylene ethylene diamine; 2,2,4- and 2,4,4-trimethyl-1,6-hexanediamine; 4,4'-bis-(sec-butylamino)-dicyclohexylmethane; 1,4-bis-(sec-butylamino)-cyclohexane; 1,2-bis-(sec-butylamino)-cyclohexane; derivatives of 4,4'-bis-(sec-butylamino)-dicyclohexylmethane; 4,4'-dicyclohexylmethane diamine; 4,4'-methylenebis-(2,6-diethylaminocyclohexane; 1,4-cyclohexane-bis-(methylamine); 1,3-cyclohexane-bis-(methylamine); diethylene glycol di-(aminopropyl)ether; 2-methylpentamethylene-diamine; diaminocyclohexane; diethylene triamine; triethylene tetramine; tetraethylene pentamine; propylene diamine; 1,3-diaminopropane; dimethylamino propylamine; diethylamino propylamine; imido-bis-propylamine; monoethanolamine, diethanolamine; triethanolamine; monoisopropanolamine, diisopropanolamine; isophoronediamine; triisopropanolamine; and mixtures thereof. In addition, any of the polyether amines listed above may be used as curing agents to react with the polyurea prepolymers.

Alternatively, other suitable polymers include partially or fully neutralized ionomer, metallocene, or other single-site catalyzed polymer, polyester, polyamide, non-ionomeric thermoplastic elastomer, copolyether-esters, copolyether-amides, polycarbonate, polybutadiene, polyisoprene, polystryrene block copolymers (such as styrene-butadiene-styrene), styrene-ethylene-propylene-styrene, styrene-ethylene-butylene-styrene, and the like, and blends thereof.

Intermediate layers and/or cover layers may also be formed from ionomeric polymers or ionomer blends such as Surlyn 7940/8940 or Surlyn 8150/9150 or from highly-neutralized ionomers (HNP).

In one embodiment, at least one intermediate layer of the golf ball is formed from an HNP material or a blend of HNP materials. The acid moieties of the HNP's, typically ethylene-based ionomers, are preferably neutralized greater than about 70%, more preferably greater than about 90%, and most preferably at least about 100% with a cation source. Suitable cations include for example metal cations, organic amine compounds, ammonium, and combinations thereof. The HNPs can be also be blended with a second polymer component, which, if containing an acid group(s) such as organic acids, or more preferably fatty acids, may be neutralized in a conventional manner, with a suitable cation source. The second polymer component, which may be partially or fully neutralized, preferably comprises ionomeric copolymers and terpolymers, ionomer precursors, thermoplastics, polyamides, polycarbonates, polyesters, polyurethanes, polyureas, thermoplastic elastomers, polybutadiene rubber, balata, metallocene-catalyzed polymers (grafted and non-grafted), single-site polymers, high-crystalline acid polymers, cationic ionomers, and the like. HNP polymers typically have a material hardness of between about 20 and about 80 Shore D, and a flexural modulus of between about 3,000 psi and about 200,000 psi.

In one embodiment of the present invention the HNPs are ionomers and/or their acid precursors that are preferably neutralized, either fully or partially, with sufficient amount of metal base to achieve the desired neutralization level. The acid copolymers are preferably α-olefin, such as ethylene, $C_{3-8}$ α,β-ethylenically unsaturated carboxylic acid, such as acrylic and methacrylic acid, copolymers. They may optionally contain a softening monomer, such as alkyl acrylate and alkyl methacrylate, wherein the alkyl groups have from 1 to 8 carbon atoms.

The acid copolymers can be described as E/X/Y copolymers where E is ethylene, X is an α,β-ethylenically unsaturated carboxylic acid, and Y is a softening comonomer. In a preferred embodiment, X is acrylic or methacrylic acid and Y is a $C_{1-8}$ alkyl acrylate or methacrylate ester. X is preferably present in an amount from about 1 to about 35 weight percent of the polymer, more preferably from about 5 to about 30 weight percent of the polymer, and most preferably from about 10 to about 22 weight percent of the polymer. Y is preferably present in an amount from about 0 to about 50 weight percent of the polymer, more preferably from about 5 to about 30 weight percent of the polymer, and most preferably from about 10 to about 25 weight percent of the polymer.

Specific acid-containing ethylene copolymers include, but are not limited to, ethylene/acrylic acid/n-butyl acrylate, ethylene/methacrylic acid/n-butyl acrylate, ethylene/methacrylic acid/iso-butyl acrylate, ethylene/acrylic acid/iso-butyl acrylate, ethylene/methacrylic acid/n-butyl methacrylate, ethylene/acrylic acid/methyl methacrylate, ethylene/acrylic acid/methyl acrylate, ethylene/methacrylic acid/methyl acrylate, ethylene/methacrylic acid/methyl methacrylate, and ethylene/acrylic acid/n-butyl methacrylate. Preferred acid-containing ethylene copolymers include, ethylene/methacrylic acid/n-butyl acrylate, ethylene/acrylic acid/n-butyl acrylate, ethylene/methacrylic acid/methyl acrylate, ethylene/acrylic acid/ethyl acrylate, ethylene/methacrylic acid/ethyl acrylate, and ethylene/acrylic acid/methyl acrylate copolymers. The most preferred acid-containing ethylene copolymers are, ethylene/(meth)acrylic acid/n-butyl acrylate, ethylene/(meth) acrylic acid/ethyl acrylate, and ethylene/(meth)acrylic acid/methyl acrylate copolymers.

Ionomers are typically neutralized with a metal cation, such as Li, Na, Mg, K, Ca, Al or Zn. It has been found that by adding sufficient organic acid or salt of organic acid, along with a suitable base, to the acid copolymer or ionomer, the ionomer can be neutralized, without losing processability, to a level much greater than for a metal cation alone. Preferably, the acid moieties are neutralized greater than about 80%, preferably from 90-100%, most preferably 100% without losing processability. This is accomplished by melt-blending an ethylene α,β-ethylenically unsaturated carboxylic acid copolymer, for example, with an organic acid or a salt of organic acid, and adding a sufficient amount of a cation source to increase the level of neutralization of all the acid moieties (including those in the acid copolymer and in the organic acid) to greater than 90%, (preferably greater than 100%).

The organic acids may be aliphatic, mono- or multi-functional (saturated, unsaturated, or multi-unsaturated) organic acids. Salts of these organic acids may also be employed. The salts of organic acids of the present invention include the salts of barium, lithium, sodium, zinc, bismuth, chromium, cobalt, copper, potassium, strontium, titanium, tungsten, magnesium, cesium, iron, nickel, silver, aluminum, tin, or calcium, salts of fatty acids, particularly stearic, behenic, erucic, oleic, linoelic or dimerized derivatives thereof. It is preferred that the organic acids and salts of the present invention be relatively non-migratory (they do not bloom to the surface of the polymer under ambient temperatures) and non-volatile (they do not volatilize at temperatures required for melt-blending).

The ionomers may also be more conventional ionomers, i.e., partially-neutralized with metal cations. The acid moiety in the acid copolymer is neutralized about 1 to about 90%, preferably at least about 20 to about 75%, and more preferably at least about 40 to about 70%, to form an ionomer, by a cation such as lithium, sodium, potassium, magnesium, calcium, barium, lead, tin, zinc, aluminum, or a mixture thereof.

The golf ball may also contain additives, ingredients, and other materials in amounts that do not detract from the properties of the final composition. These additive materials include, but are not limited to, activators such as calcium or magnesium oxide; fatty acids such as stearic acid and salts thereof; fillers and reinforcing agents such as organic or inorganic particles, for example, clays, talc, calcium, magnesium carbonate, silica, aluminum silicates, zeolites, powdered metals, and organic or inorganic fibers, plasticizers such as dialkyl esters of dicarboxylic acids; surfactants; softeners; tackifiers; waxes; ultraviolet (UV) light absorbers and stabilizers; antioxidants; optical brighteners; whitening agents such as titanium dioxide and zinc oxide; dyes and pigments; processing aids; release agents; and wetting agents. These compositions provide improved melt processability, and a balance of ball performance.

Blowing/foaming agents may also be compatible with and be included in golf balls of the invention, including, for example those disclosed in U.S. Pat. No. 7,708,654. Typical physical foaming/blowing agents include volatile liquids such as freons (CFCs), other halogenated hydrocarbons, water, aliphatic hydrocarbons, gases, and solid blowing agents, i.e., compounds that liberate gas as a result of desorption of gas. Preferably, the blowing agent includes an adsorbent. Typical adsorbents include, for example, activated carbon, calcium carbonate, diatomaceous earth, and silicates saturated with carbon dioxide.

Chemical foaming/blowing agents may be incorporated. Chemical blowing agents may be inorganic, such as ammonium carbonate and carbonates of alkalai metals, or may be organic, such as azo and diazo compounds, such as nitrogen-based azo compounds. Suitable azo compounds include, but are not limited to, 2,2'-azobis(2-cyanobutane), 2,2'-azobis (methylbutyronitrile), azodicarbonamide, p,p'-oxybis(benzene sulfonyl hydrazide), p-toluene sulfonyl semicarbazide, p-toluene sulfonyl hydrazide. Other blowing agents include any of the Celogens®, sold by Crompton Chemical Corporation, and nitroso compounds, sulfonylhydrazides, azides of organic acids and their analogs, triazines, tri- and tetrazole derivatives, sulfonyl semicarbazides, urea derivatives, guanidine derivatives, and esters such as alkoxyboroxines. Other possible blowing agents include agents that liberate gasses as a result of chemical interaction between components such as mixtures of acids and metals, mixtures of organic acids and inorganic carbonates, mixtures of nitriles and ammonium salts, and the hydrolytic decomposition of urea.

Alternatively, low specific gravity can be achieved by incorporating low density fillers or agents such as hollow fillers or microspheres in the polymeric matrix, where the cured composition has the preferred specific gravity. Moreover, the polymeric matrix can be foamed to decrease its specific gravity, microballoons, or other low density fillers as described in U.S. Pat. No. 6,692,380 ("'380 patent"). The '380 patent is incorporated by reference in its entirety.

Blends including non-ionomeric and olefin-based ionomeric polymers may also be incorporated to form a golf ball layer. Examples of non-ionomeric polymers include vinyl resins, polyolefins including those produced using a single-site catalyst or a metallocene catalyst, polyurethanes, polyureas, polyamides, polyphenylenes, polycarbonates, polyesters, polyacrylates, engineering thermoplastics, and the like. Also, in one embodiment of the invention, processability of the golf ball of the invention may even be enhanced by incorporating in the core a metallocene-catalyzed polybutadiene.

Olefin-based ionomers, such as ethylene-based copolymers, are often made from an unsaturated carboxylic acid, such as methacrylic acid, acrylic acid, or maleic acid. Other possible carboxylic acid groups include, for example, crotonic, maleic, fumaric, and itaconic acid. "Low acid" and "high acid" olefin-based ionomers, as well as blends of such ionomers, may be used. In general, low acid ionomers are considered to be those containing 16 wt. % or less of carboxylic acid, whereas high acid ionomers are considered to be those containing greater than 16 wt. % of carboxylic acid. The acidic group in the olefin-based ionic copolymer is partially or totally neutralized with metal ions such as zinc, sodium, lithium, magnesium, potassium, calcium, manganese, nickel, chromium, copper, or a combination thereof. For example, ionomeric resins having carboxylic acid groups that are neutralized from about 10 percent to about 100 percent may be used. In one embodiment, the acid groups are partially neutralized. That is, the neutralization level is from 10 to 80%, more preferably 20 to 70%, and most preferably 30 to 50%. In another embodiment, the acid groups are highly or fully neutralized. Or, the neutralization level may be from about 80 to 100%, more preferably 90 to 100%, and most preferably 95 to 100%. The blend may contain about 5 to about 30% by weight of a moisture barrier composition and about 95 to about 70% by weight of a partially, highly, or fully-neutralized olefin-based ionomeric copolymer. The above-mentioned blends may contain one or more suitable compatibilizers such as glycidyl acrylate or glycidyl methacrylate or maleic anhydride containing-polymers.

Any method known in the art for measuring neutralization, hardness, modulus and melt flow of golf ball centers and layers may be used.

A golf ball of the invention may have a compression of from about 25 to about 110. In another embodiment, the overall golf ball has a compression of from about 35 to about 100. In yet another embodiment, the overall golf ball has a compression of from about 45 to about 95. In still another embodiment, the compression may be from about 55 to about 85, or from about 65 to about 75. Meanwhile, the compression may also be from about 50 to about 110, or from about 60 to about 100, or from about 70 to about 90, or even from about 80 to about 110.

Several different methods can be used to measure compression, including Atti compression, Riehle compression, load/deflection measurements at a variety of fixed loads and offsets, and effective modulus. See, e.g., *Compression by Any Other Name, Science and Golf IV, Proceedings of the World Scientific Congress of Golf* (Eric Thain ed., Routledge, 2002) ("J. Dalton") The term compression, as used herein, refers to Atti or PGA compression and is measured using an Atti compression test device. A piston compresses a ball against a spring and the piston remains fixed while deflection of the spring is measured at 1.25 mm (0.05 inches). Where a core has a very low stiffness, the compression measurement will be zero at 1.25 mm. In order to measure the compression of a core using an Atti compression tester, the core must be shimmed to a diameter of 1.680 inches because these testers are designed to measure objects having that diameter. Atti compression units can be converted to Riehle (cores), Riehle (balls), 100 kg deflection, 130-10 kg deflection or effective modulus using the formulas set forth in J. Dalton. The approximate relationship that exists between Atti or PGA compression and Riehle compression can be expressed as: (Atti or PGA compression)=(160-Riehle Compression). Thus, a Riehle compression of 100 would be the same as an Atti compression of 60.

Generally, in golf balls of the invention, the overall golf ball COR is at least about 0.780. In another embodiment, the overall golf ball COR is at least about 0.788. In yet another embodiment, the overall golf ball COR is at least about 0.791. In still another embodiment, the overall golf ball COR is at least about 0.794. Also, the overall golf ball COR may be at least about 0.797. The overall golf ball COR may even be at least about 0.800, or at least about 0.803, or at least about 0.812.

COR, as used herein, is determined by firing a golf ball or golf ball subassembly (e.g., a golf ball core) from an air cannon at two given velocities and calculating the COR at a velocity of 125 ft/s. Ball velocity is calculated as a ball approaches ballistic light screens which are located between the air cannon and a steel plate at a fixed distance. As the ball travels toward the steel plate, each light screen is activated, and the time at each light screen is measured. This provides an incoming transit time period inversely proportional to the ball's incoming velocity. The ball impacts the steel plate and rebounds through the light screens, which again measure the time period required to transit between the light screens. This provides an outgoing transit time period inversely proportional to the ball's outgoing velocity. COR is then calculated as the ratio of the outgoing transit time period to the incoming transit time period, $COR=V_{out}/V_{in}=T_{in}/T_{out}$. Preferably, a golf ball according to the present invention has a COR of at least about 0.78, more preferably, at least about 0.80.

The spin rate of a golf ball also remains an important golf ball characteristic. High spin rate allows skilled players more flexibility in stopping the ball on the green if they are able to control a high spin ball. On the other hand, recreational players often prefer a low spin ball since they do not have the ability to intentionally control the ball, and lower spin balls tend to drift less off the green.

Golf ball spin is dependent on variables including, for example, distribution of the density or specific gravity within a golf ball. For example, when the center has a higher density or specific gravity than the outer layers, a lower moment of inertia results which increases spin rate. Alternatively, when the density or specific gravity is concentrated in the outer regions of the golf ball, a higher moment of inertia results with a lower spin rate. The moment of inertia for a golf ball of the invention may be from about 0.410 oz-in$^2$ to about 0.470 oz-in$^2$. The moment of inertia for a one piece ball that is 1.62 ounces and 1.68 inches in diameter may be approximately 0.4572 oz-in$^2$, which is the baseline moment of inertia value.

Accordingly, by varying the materials and the density of the regions of each core or cover layer, different moments of inertia may be achieved for the golf ball of the present invention. In one embodiment, the resulting golf ball has a moment of inertia of from about to 0.440 to about 0.455 oz-in$^2$. In another embodiment, the golf balls of the present invention have a moment of inertia of from about 0.456 oz-in$^2$ to about 0.470 oz-in$^2$. In yet another embodiment, the golf ball has a moment of inertia of from about 0.450 oz-in$^2$ to about 0.460 oz-in$^2$.

The following non-limiting prophetic examples in TABLE I and TABLE II below illustrate several embodiments of golf balls according to the invention.

TABLE I

| Ex. No. | Color Contributing Component 1 - Hue, Saturation, Chroma | Color Contributing Component 2 - Hue, Saturation, Chroma | Overall Golf Ball Hue, Saturation, and Chroma |
|---|---|---|---|
| 1 | Cover ($H_1$, $S_1$, $C_1$) | Coating ($H_1$, $S_2$*, $C_1$) | $H_1$, $S_3$*($S_2 < S_3 > S_1$), $C_1$ |
| 2 | Intermediate Layer($H_1$, $S_1$, $C_1$) | Cover ($H_1$, $S_2$, $C_1$) | $H_1$, $S_3$($S_2 < S_3 > S_1$), $C_1$ |

TABLE I-continued

| Ex. No. | Color Contributing Component 1 - Hue, Saturation, Chroma | Color Contributing Component 2 - Hue, Saturation, Chroma | Overall Golf Ball Hue, Saturation, and Chroma |
|---|---|---|---|
| 3 | Intermediate Layer ($H_1$, $S_1$, $C_1$) | Coating ($H_1$, $S_2$, $C_1$) | $H_1$, $S_3(S_2 < S_3 > S_1)$, $C_1$ |
| 4 | Core ($H_1$, $S_1$, $C_1$) | Cover ($H_1$, $S_2$, $C_1$) | $H_1$, $S_3(S_2 < S_3 > S_1)$, $C_1$ |
| 5 | Inner Cover Layer ($H_1$, $S_1$, $C_1$) | Outer Cover Layer ($H_1$, $S_2$, $C_1$) | $H_1$, $S_3(S_2 < S_3 > S_1)$, $C_1$ |
| 6 | Core ($H_1$, $S_1$, $C_1$) | Intermediate Layer ($H_1$, $S_2$, $C_1$) | $H_1$, $S_3(S_2 < S_3 > S_1)$, $C_1$ |
| 7 | Cover ($H_1$, $S_1$, $C_1$) | Coating ($H_1$, $S_2$, $C_2$**) | $H_1$, $S_3(S_2 < S_3 > S_1)$, $C_3$** |
| 8 | Intermediate Layer ($H_1$, $S_1$, $C_1$) | Cover ($H_1$, $S_2$, $C_2$) | $H_1$, $S_3(S_2 < S_3 > S_1)$, $C_3$*** |
| 9 | Intermediate Layer ($H_1$, $S_1$, $C_1$) | Coating ($H_1$, $S_2$, $C_2$) | $H_1$, $S_3(S_2 < S_3 > S_1)$, $C_3$ |
| 10 | Core ($H_1$, $S_1$, $C_1$) | Cover ($H_1$, $S_2$, $C_2$) | $H_1$, $S_3(S_2 < S_3 > S_1)$, $C_3$ |
| 11 | Inner Cover Layer ($H_1$, $S_1$, $C_1$) | Outer Cover Layer ($H_1$, $S_2$, $C_2$) | $H_1$, $S_3(S_2 < S_3 > S_1)$, $C_3$ |
| 12 | Core ($H_1$, $S_1$, $C_1$) | Intermediate Layer ($H_1$, $S_2$, $C_2$) | $H_1$, $S_3(S_2 < S_3 > S_1)$, $C_3$ |
| 13 | Cover ($H_1$, $S_1$, $C_2$) | Coating ($H_1$, $S_2$, $C_1$) | $H_1$, $S_3(S_2 < S_3 > S_1)$, $C_4$** |
| 14 | Intermediate Layer ($H_1$, $S_1$, $C_2$) | Cover ($H_1$, $S_2$, $C_1$) | $H_1$, $S_3(S_2 < S_3 > S_1)$, $C_4$*** |
| 15 | Intermediate Layer ($H_1$, $S_1$, $C_2$) | Coating ($H_1$, $S_2$, $C_1$) | $H_1$, $S_3(S_2 < S_3 > S_1)$, $C_4$ |
| 16 | Core ($H_1$, $S_1$, $C_2$) | Cover ($H_1$, $S_2$, $C_1$) | $H_1$, $S_3(S_2 < S_3 > S_1)$, $C_4$ |
| 17 | Inner Cover Layer ($H_1$, $S_1$, $C_2$) | Outer Cover Layer ($H_1$, $S_2$, $C_1$) | $H_1$, $S_3(S_2 < S_3 > S_1)$, $C_4$ |
| 18 | Core ($H_1$, $S_1$, $C_2$) | Intermediate Layer ($H_1$, $S_2$, $C_1$) | $H_1$, $S_3(S_2 < S_3 > S_1)$, $C_4$ |
| 19 | Coating($H_1$, $S_1$, $C_2$) | Interference effect pigment in coating($H_1$, $S_2$, $C_1$) | $H_1$, $S_3(S_2 < S_3 > S_1)$, $C_3$ |

*In each example herein, $S_1$ is different than $S_2$, and $S_3$ is different than $S_1$ and $S_2$.

**In each example herein, $C_1$ is different than $C_2$, $C_3$ is different than $C_1$ and $C_2$, $C_4$ is different than $C_1$ and $C_2$, and $C_3$ is different than $C_4$.

***In each example herein, for $C_3$ or $C_4$, any of the following may be true: $C_2 < C_3 < C_1$; $C_2 > C_3 > C_1$; $C_2 \neq C_3 < C_1$; $C_2 < C_3 \neq C_1$; $C_2 < C_4 < C_1$; $C_2 > C_4 > C_1$; $C_2 \neq C_4 < C_1$; $C_2 < C_4 \neq C_1$.

TABLE II

| Ex. No. (From TABLE I) | Resulting Saturation and Chroma of Overall Golf Ball |
|---|---|
| 1 | $S_2$ is greater than $S_1$ by 95% and $S_3 > S_2$<br>Chroma is constant throughout golf ball |
| 2 | $S_2$ is greater than $S_1$ by 90% and $S_3 > S_2$<br>Chroma is constant |
| 3 | $S_2$ is greater than $S_1$ by 85% and $S_3 > S_2$<br>Chroma is constant |
| 4 | $S_2$ is greater than $S_1$ by 92% and $S_3 > S_2$<br>Chroma is constant |
| 5 | $S_2$ is greater than $S_1$ by 78% and $S_3 > S_2$<br>Chroma is constant |
| 6 | $S_2$ is greater than $S_1$ by 56% and $S_3 > S_2$<br>Chroma is constant |
| 7 | $S_2$ is greater than $S_1$ by 95% and $S_3 > S_2$<br>$C_2$ is greater than $C_1$ by 15% and $C_3 > C_2$ |
| 8 | $S_2$ is greater than $S_1$ by 90% and $S_3 > S_2$<br>$C_2$ is greater than $C_1$ by 80% and $C_3 > C_2$ |
| 9 | $S_2$ is greater than $S_1$ by 85% and $S_3 > S_2$<br>$C_2$ is greater than $C_1$ by 55% and $C_3 > C_2$ |
| 10 | $S_2$ is greater than $S_1$ by 92% and $S_3 > S_2$<br>$C_2$ is greater than $C_1$ by 35% and $C_3 > C_2$ |
| 11 | $S_2$ is greater than $S_1$ by 78% and $S_3 > S_2$<br>$C_2$ is greater than $C_1$ by 70% and $C_3 > C_2$ |
| 12 | $S_2$ is greater than $S_1$ by 56% and $S_3 > S_2$<br>$C_2$ is greater than $C_1$ by 90% and $C_3 > C_2$ |
| 13 | $S_2$ is greater than $S_1$ by 95% and $S_3 > S_2$<br>$C_2$ is greater than $C_1$ by 15% and $C_2 > C_4 > C_1$ |
| 14 | $S_2$ is greater than $S_1$ by 90% and $S_3 > S_2$<br>$C_2$ is greater than $C_1$ by 80% and $C_2 > C_4 > C_1$ |
| 15 | $S_2$ is greater than $S_1$ by 85% and $S_3 > S_2$<br>$C_2$ is greater than $C_1$ by 55% and $C_2 > C_4 > C_1$ |
| 16 | $S_2$ is greater than $S_1$ by 92% and $S_3 > S_2$<br>$C_2$ is greater than $C_1$ by 35% and $C_2 > C_4 > C_1$ |
| 17 | $S_2$ is greater than $S_1$ by 78% and $S_3 > S_2$<br>$C_2$ is greater than $C_1$ by 70% and $C_2 > C_4 > C_1$ |
| 18 | $S_2$ is greater than $S_1$ by 56% and $S_3 > S_2$<br>$C_2$ is greater than $C_1$ by 90% and $C_2 > C_4 > C_1$ |
| 19 | $S_2$ is greater than $S_1$ by 95% and $S_3 > S_2$<br>$C_2$ is greater than $C_1$ by 80% and $C_3 > C_2$ |

Unless otherwise expressly specified, all of the numerical ranges, amounts, values and percentages such as those for amounts of materials, and others in the specification may be read as if prefaced by the word "about" even though the term "about" may not expressly appear with the value, amount or range. Accordingly, unless indicated to the contrary, the numerical parameters set forth in the specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

While it is apparent that the illustrative embodiments of the invention disclosed herein fulfill the preferred embodiments of the present invention, it is appreciated that numerous modifications and other embodiments may be devised by those skilled in the art. Examples of such modifications include reasonable variations of the numerical values and/or materials and/or components discussed above. Hence, the numerical values stated above and claimed below specifically include those values and the values that are approximate to those stated and claimed values. Therefore, it will be understood that the appended claims are intended to cover all such modifications and embodiments, which would come within the spirit and scope of the present invention.

The invention described and claimed herein is not to be limited in scope by the specific embodiments herein disclosed, since these embodiments are intended as illustrations of several aspects of the invention. Any equivalent embodiments are intended to be within the scope of this invention. Indeed, various modifications of the invention in addition to those shown and described herein will become apparent to those skilled in the art from the foregoing description. For example, the compositions of the present invention may be used in a variety of equipment. Such modifications are also intended to fall within the scope of the appended claims.

While any of the embodiments herein may have any known dimple number and pattern, a preferred number of dimples is 252 to 456, and more preferably is 300 to 392. The dimples may comprise any width, depth, and edge angle and patterns which satisfy the relationships defined between cover layers as disclosed herein. The parting line configuration of said pattern may be either a straight line or a staggered wave parting line (SWPL). In one embodiment, the golf ball has 302, 320, 328, 330, 332, 352 or 392 dimples, comprises 5 to 7 dimples sizes, and the parting line is a SWPL.

In any of these embodiments the single-layer core may be replaced with a two or more layer core wherein at least one core layer has a negative hardness gradient. Other than in the operating examples, or unless otherwise expressly specified, all of the numerical ranges, amounts, values and percentages such as those for amounts of materials and others in the specification may be read as if prefaced by the word "about" even though the term "about" may not expressly appear with the value, amount or range.

Accordingly, unless indicated to the contrary, the numerical parameters set forth in the specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

What is claimed is:

1. A golf ball comprising a core and a cover disposed about the core;

wherein the core comprises at least one layer comprising a first color contributing component and wherein the cover comprises at least one layer comprising a second color contributing component;

said first color contributing component comprising a colorant that contributes to an overall golf ball color, and said second color contributing component comprising a colorant that contributes to the overall golf ball color;

said first color contributing component having a hue that is substantially similar to a hue of the second color contributing component; and the first color contributing component further having a saturation that is different than a saturation of the second color contributing component;

wherein the hue and saturation and a chroma of the first color contributing component and the hue and saturation and a chroma of the second color contributing component contribute to an overall golf ball hue, saturation and chroma such that: the overall golf ball hue is substantially similar to the hue of the first color contributing component and the hue of the second color contributing component; wherein the overall golf ball saturation is greater than the saturation of the first color contributing component and less than the saturation of the second color contributing component; and the overall golf ball chroma is different than at least one of the chroma of the first color contributing component and the chroma of the second color contributing component.

2. The golf ball of claim 1, wherein the saturation of the first contributing component and the saturation of the second color contributing component differ by from about 95% to about 99%.

3. The golf ball of claim 1, wherein the saturation of the first contributing component and the saturation of the second color contributing component differ by from about 80% to about 90%.

4. The golf ball of claim 1, wherein the saturation of the first contributing component and the saturation of the second color contributing component differ by from about 70% to about 80%.

5. The golf ball of claim 1, wherein the saturation of the first contributing component and the saturation of the second color contributing component differ by from about 50% to about 70%.

6. The golf ball of claim 1, wherein the saturation of the first contributing component and the saturation of the second color contributing component differ by from about 15% to about 50%.

7. The golf ball of claim 1, wherein the saturation of the first contributing component and the saturation of the second color contributing component differ by greater than about 56%.

8. The golf ball of claim 1, wherein the saturation of the first contributing component and the saturation of the second color contributing component differ by up to about 99%.

9. The golf ball of claim 1, wherein the overall golf ball chroma is different than at least one of the chroma of the first color contributing component and the chroma of the second color contributing component by from about 85% to about 95%.

10. The golf ball of claim 1, wherein the overall golf ball chroma is different than at least one of the chroma of the first color contributing component and the chroma of the second color contributing component by at least about 50%.

11. A golf ball comprising a core and a cover disposed about the core;

wherein the core comprises at least one layer comprising a first color contributing component and wherein the cover comprises at least one layer comprising a second color contributing component;

said first color contributing component comprising a colorant that contributes to an overall golf ball color, and said second color contributing component comprising a colorant that contributes to the overall golf ball color;

said first color contributing component having a hue that is substantially similar to a hue of the second color contributing component; and the first color contributing component further having a saturation that is different than a saturation of the second color contributing component;

wherein the hue and saturation and a chroma of the first color contributing component and the hue and saturation and a chroma of the second color contributing component contribute to an overall golf ball hue, saturation and chroma such that: the overall golf ball hue is substantially similar to the hue of the first color contributing component and the hue of the second color contributing component; wherein the overall golf ball saturation is less than the saturation of the first color contributing component and greater than the saturation of the second color contributing component; and the overall golf ball chroma is different than at least one of the chroma of the first color contributing component and the chroma of the second color contributing component.

12. The golf ball of claim 11, wherein the saturation of the first contributing component and the saturation of the second color contributing component differ by from about 90% to about 99%.

13. The golf ball of claim 11, wherein the saturation of the first contributing component and the saturation of the second color contributing component differ by greater than about 95%.

14. The golf ball of claim 11, wherein the saturation of the first contributing component and the saturation of the second color contributing component differ by greater than about 98%.

15. The golf ball of claim 11, wherein the saturation of the first contributing component and the saturation of the second color contributing component differ by greater than about 15%.

16. The golf ball of claim 11, wherein the saturation of the first contributing component and the saturation of the second color contributing component differ by less than about 100%.

17. The golf ball of claim 11, wherein the overall golf ball chroma is different than at least one of the chroma of the first color contributing component and the chroma of the second color contributing component by from about 50% to about 75%.

18. The golf ball of claim 11, wherein the overall golf ball chroma is different than at least one of the chroma of the first color contributing component and the chroma of the second color contributing component by at least about 15%.

19. A golf ball comprising a core and a cover disposed about the core;

wherein the core comprises at least one layer comprising a first color contributing component and wherein the cover comprises at least one layer comprising a second color contributing component;

said first color contributing component comprising a colorant that contributes to an overall golf ball color, and said second color contributing component comprising a colorant that contributes to the overall golf ball color;

said first color contributing component having a hue that is substantially similar to a hue of the second color contributing component; and the first color contributing component further having a saturation that is different than a saturation of the second color contributing component;

wherein the hue and saturation and a chroma of the first color contributing component and the hue and saturation and a chroma of the second color contributing component contribute to an overall golf ball hue, saturation and chroma such that: the overall golf ball hue is substantially similar to the hue of the first color contributing component and the hue of the second color contributing component; wherein the overall golf ball saturation is different than at least one of the saturation of the first color contributing component and the saturation of the second color contributing component by at least about 25%, and the overall golf ball chroma is different than at least one of the chroma of the first color contributing component and the chroma of the second color contributing component by at least about 25%.

20. A golf ball comprising a core, a cover disposed about the core and a coating formed on an outer surface of the cover;

wherein the core comprises at least one layer comprising a first color contributing component and wherein the cover comprises at least one layer comprising a second color contributing component;

said first color contributing component comprising a colorant that contributes to an overall golf ball color, and said second color contributing component comprising a colorant that contributes to the overall golf ball color;

said first color contributing component having a hue that is substantially similar to a hue of the second color contributing component; and the first color contributing component further having a saturation that is different than a saturation of the second color contributing component;

wherein the coating comprises a third color contributing component comprising a colorant that contributes to an overall golf ball color, said third color contributing component having a hue that is substantially similar to the hue of the first color contributing component and the hue of the second color contributing component;

the third color contributing component further having a saturation greater than the saturation of the first color contributing component and the saturation of the second color contributing component such that an overall golf ball saturation is substantially similar to the saturation of the first color contributing component or the saturation of the second color contributing component, and an overall golf ball chroma is different than a chroma of the first color contributing component and a chroma of the second color contributing component.

21. A golf ball comprising a core, a cover disposed about the core and a coating formed on an outer surface of the cover;

wherein the core comprises at least one layer comprising a first color contributing component and wherein the cover comprises at least one layer comprising a second color contributing component;

said first color contributing component comprising a colorant that contributes to an overall golf ball color, and said second color contributing component comprising a colorant that contributes to the overall golf ball color;

said first color contributing component having a hue that is substantially similar to a hue of the second color contributing component; and the first color contributing component further having a saturation that is different than a saturation of the second color contributing component;

wherein the coating comprises a third color contributing component comprising a colorant that contributes to an overall golf ball color, said third color contributing component having a hue that is substantially similar to the hue of the first color contributing component and the hue of the second color contributing component;

the third color contributing component further having a saturation less than the saturation of the first color contributing component and the saturation of the second color contributing component such that the overall golf ball saturation is substantially similar to the saturation of the first color contributing component or the saturation of second color contributing component, and an overall golf ball chroma is different than a chroma of the first color contributing component and a chroma of the second color contributing component.

* * * * *